US008570839B2

(12) United States Patent
Nomura et al.

(10) Patent No.: US 8,570,839 B2
(45) Date of Patent: Oct. 29, 2013

(54) TIME-INFORMATION OBTAINING APPARATUS AND RADIO-CONTROLLED TIMEPIECE

(75) Inventors: Keiichi Nomura, Uenohara (JP); Hideo Abe, Tokorozawa (JP)

(73) Assignee: Casio Computer Co., Ltd., Tokyo (JP)

( * ) Notice: Subject to any disclaimer, the term of this patent is extended or adjusted under 35 U.S.C. 154(b) by 174 days.

(21) Appl. No.: 13/297,405

(22) Filed: Nov. 16, 2011

(65) Prior Publication Data

US 2012/0134241 A1 May 31, 2012

(30) Foreign Application Priority Data

Nov. 26, 2010 (JP) ..... 2010-263206

(51) Int. Cl.
*G04C 11/02* (2006.01)
*G04R 20/12* (2013.01)

(52) U.S. Cl.
CPC ..... *G04R 20/12* (2013.01)
USPC ..... 368/47; 702/178

(58) Field of Classification Search
USPC ..... 368/47
See application file for complete search history.

(56) References Cited

U.S. PATENT DOCUMENTS 7,428,190 B2 * 9/2008 Sano ..... 368/47
2005/0195690 A1 9/2005 Kondo
2009/0231963 A1 9/2009 Abe
2009/0248357 A1 10/2009 Abe
2011/0075522 A1 * 3/2011 Abe et al. ..... 368/47
2012/0082008 A1 * 4/2012 Eliezer et al. ..... 368/47

FOREIGN PATENT DOCUMENTS

JP 2005-249632 9/2005
JP 2009-216544 9/2009

OTHER PUBLICATIONS

Japanese Office Action for Japanese Application No. 2010-263206 mailed on Oct. 30, 2012.
Partial European Search Report for European Application No. 11190430.6-1240 issued on May 12, 2012.

* cited by examiner

*Primary Examiner* — Vit W Miska
(74) *Attorney, Agent, or Firm* — Turocy & Watson, LLP

(57) ABSTRACT

A time-information obtaining apparatus is provided with an input waveform data pattern generating unit for sampling a received standard-time radio wave signal to generate an input waveform data pattern, an internal time counting unit for generate a base time, a calculation-waveform data pattern generating unit for generating plural calculation-waveform data patterns based on the base time, an invalid-bit detecting unit for detecting in the plural calculation-waveform data patterns, invalid bits not to be compared with the input waveform data pattern, an error counting unit for comparing the sample values of valid bits of the plural calculation-waveform data patterns with the invalid bits removed and the corresponding sample values of the input waveform data pattern to detect discrepancies between them, and a present-time correcting unit for correcting the base time based on the calculation-waveform data pattern having the smallest number of errors.

19 Claims, 23 Drawing Sheets

CODE "0"

CODE "1"

POSITION
MARKER CODE "P"

FIG. 9A

JJY:f=40kHz,60kHz

| sec | 0 | 1 | 2 | 3 | 4 | 5 | 6 | 7 | 8 | 9 | 10 | 11 | 12 | 13 | 14 | 15 | 16 | 17 | 18 | 19 |
|---|---|---|---|---|---|---|---|---|---|---|---|---|---|---|---|---|---|---|---|---|
| JJY | P | 40 | 20 | 10 | 0 | 8m | 4m | 2m | 1m | P1 | 0 | 0 | 20h | 10h | 0 | 8h | 4h | 2h | 1h | P2 |
| | M | 10 MINUTE DIGITS | | | ENLARGEMENT | 1 MINUTE DIGITS | | | | MARKER | ENLARGEMENT | | 10 HOUR DIGITS | | ENLARGEMENT | 1 HOUR DIGITS | | | | MARKER |

910
911
901
902
903

FIG. 9B

| sec | 20 | 21 | 22 | 23 | 24 | 25 | 26 | 27 | 28 | 29 | 30 | 31 | 32 | 33 | 34 | 35 | 36 | 37 | 38 | 39 |
|---|---|---|---|---|---|---|---|---|---|---|---|---|---|---|---|---|---|---|---|---|
| JJY | 0 | 0 | 200d | 100d | 0 | 80d | 40d | 20d | 10d | P3 | 8d | 4d | 2d | 1d | 0 | 0 | PA1 | PA2 | SU1 | P4 |
| | ENLARGEMENT | | 100 DAY DIGITS | | ENLARGEMENT | 10 DAY DIGITS | | | | MARKER | 1 DAY DIGITS | | | | ENLARGEMENT | | HOUR P | MINUTE P | SUMMER SPARE | MARKER |

912
904
905
906

FIG. 9C

| sec | 40 | 41 | 42 | 43 | 44 | 45 | 46 | 47 | 48 | 49 | 50 | 51 | 52 | 53 | 54 | 55 | 56 | 57 | 58 | 59 |
|---|---|---|---|---|---|---|---|---|---|---|---|---|---|---|---|---|---|---|---|---|
| JJY | SU2 | 80y | 40y | 20y | 10y | 8y | 4y | 2y | 1y | P5 | 4w | 2w | 1w | LS1 | LS2 | 0 | 0 | 0 | 0 | P0 |
| | SUMMER PRACTICE | 10 YEAR DIGITS | | | | 1 YEAR DIGITS | | | | MARKER | DAY OF THE WEEK | | | LEAP SECONDS | | ENLARGEMENT | | | | MARKER |

907
908

INPUT WAVEFORM DATA

PP(0) : ΔS=−2

PP(1) : ΔS=−1

PP(2) : ΔS=0

PP(3) : ΔS=1

PP(4) : ΔS=2

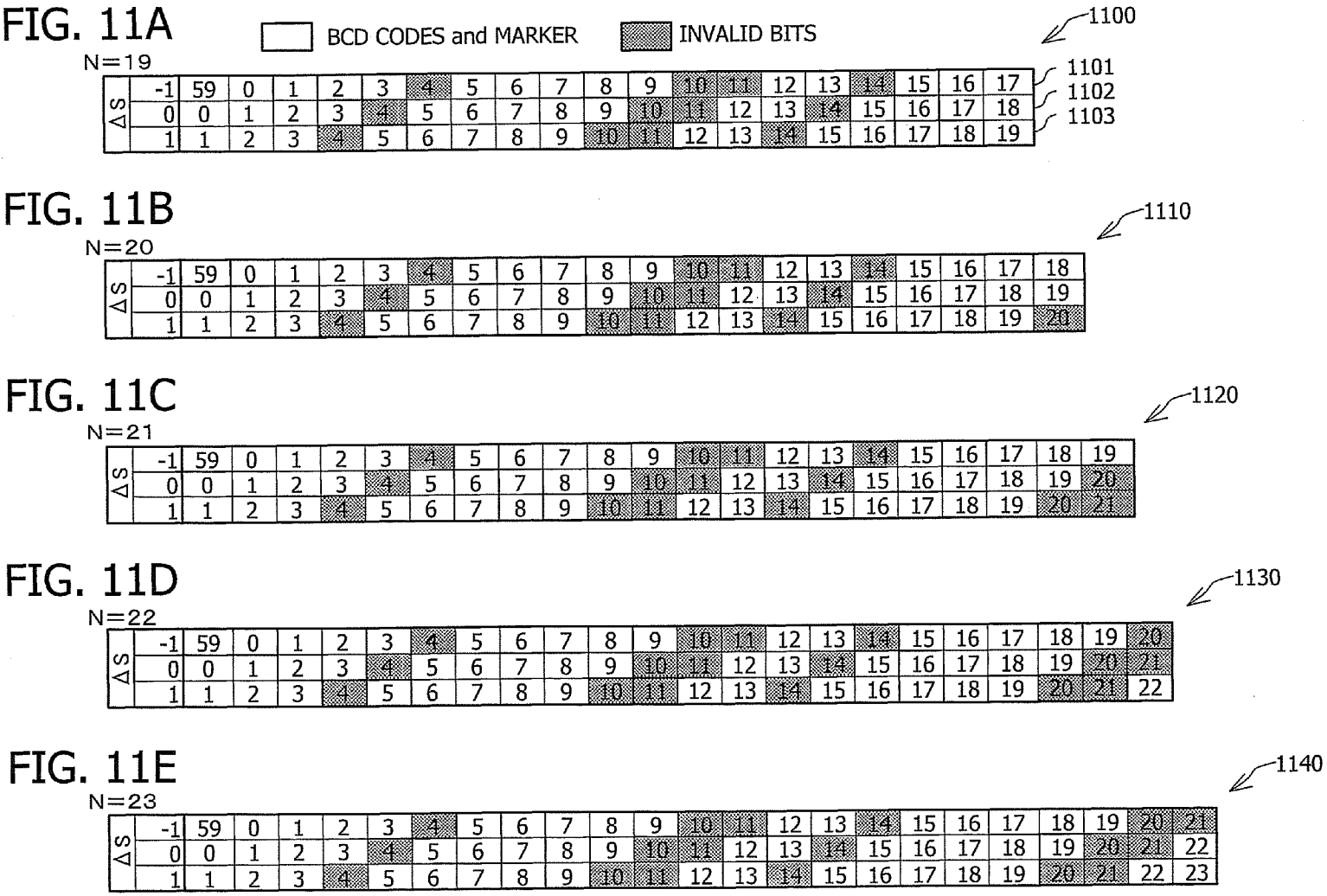
FIG. 11A N=19
FIG. 11B N=20
FIG. 11C N=21
FIG. 11D N=22
FIG. 11E N=23

FIG. 12A

N=19

| NUMBER OF ORIGINAL BITS | NUMBER OF INVALID BITS | NUMBER OF VALID BITS |
|---|---|---|
| 19 | 4 | 15 |
| 19 | 4 | 15 |
| 19 | 4 | 15 |

NUMBER N' OF VALID BITS AFTER ADJUSTMENT

N'=15

FIG. 12B

N=20

| NUMBER OF ORIGINAL BITS | NUMBER OF INVALID BITS | NUMBER OF VALID BITS |
|---|---|---|
| 20 | 4 | 16 |
| 20 | 4 | 16 |
| 20 | 5 | 15 |

N'=15

FIG. 12C

N=21

| NUMBER OF ORIGINAL BITS | NUMBER OF INVALID BITS | NUMBER OF VALID BITS |
|---|---|---|
| 21 | 4 | 17 |
| 21 | 5 | 16 |
| 21 | 6 | 15 |

N'=15

FIG. 12D

N=22

| NUMBER OF ORIGINAL BITS | NUMBER OF INVALID BITS | NUMBER OF VALID BITS |
|---|---|---|
| 22 | 5 | 17 |
| 22 | 6 | 16 |
| 22 | 6 | 16 |

N'=16

FIG. 12E

N=23

| NUMBER OF ORIGINAL BITS | NUMBER OF INVALID BITS | NUMBER OF VALID BITS |
|---|---|---|
| 23 | 6 | 17 |
| 23 | 6 | 17 |
| 23 | 6 | 17 |

N'=17

BCD CODES and MARKER | INVALID BITS | BITS TO BE REMOVED IN BIT-LENGTH ADJUSTMENT

1300

FIG. 13A

N=19

| ΔS | | | | | | | | | | | | | | | | | | | |
|---|---|---|---|---|---|---|---|---|---|---|---|---|---|---|---|---|---|---|---|
| -1 | 59 | 0 | 1 | 2 | 3 | 4 | 5 | 6 | 7 | 8 | 9 | 10 | 11 | 12 | 13 | 14 | 15 | 16 | 17 |
| 0 | 0 | 1 | 2 | 3 | 4 | 5 | 6 | 7 | 8 | 9 | 10 | 11 | 12 | 13 | 14 | 15 | 16 | 17 | 18 |
| 1 | 1 | 2 | 3 | 4 | 5 | 6 | 7 | 8 | 9 | 10 | 11 | 12 | 13 | 14 | 15 | 16 | 17 | 18 | 19 |

1310

FIG. 13B

N=20

1313 1311 1312 1314

| ΔS | | | | | | | | | | | | | | | | | | | | |
|---|---|---|---|---|---|---|---|---|---|---|---|---|---|---|---|---|---|---|---|---|
| -1 | 59 | 0 | 1 | 2 | 3 | 4 | 5 | 6 | 7 | 8 | 9 | 10 | 11 | 12 | 13 | 14 | 15 | 16 | 17 | 18 |
| 0 | 0 | 1 | 2 | 3 | 4 | 5 | 6 | 7 | 8 | 9 | 10 | 11 | 12 | 13 | 14 | 15 | 16 | 17 | 18 | 19 |
| 1 | 1 | 2 | 3 | 4 | 5 | 6 | 7 | 8 | 9 | 10 | 11 | 12 | 13 | 14 | 15 | 16 | 17 | 18 | 19 | 20 |

1320

FIG. 13C

N=21

1323 1321 1322 1324

| ΔS | | | | | | | | | | | | | | | | | | | | | |
|---|---|---|---|---|---|---|---|---|---|---|---|---|---|---|---|---|---|---|---|---|---|
| -1 | 59 | 0 | 1 | 2 | 3 | 4 | 5 | 6 | 7 | 8 | 9 | 10 | 11 | 12 | 13 | 14 | 15 | 16 | 17 | 18 | 19 |
| 0 | 0 | 1 | 2 | 3 | 4 | 5 | 6 | 7 | 8 | 9 | 10 | 11 | 12 | 13 | 14 | 15 | 16 | 17 | 18 | 19 | 20 |
| 1 | 1 | 2 | 3 | 4 | 5 | 6 | 7 | 8 | 9 | 10 | 11 | 12 | 13 | 14 | 15 | 16 | 17 | 18 | 19 | 20 | 21 |

1330

FIG. 13D

N=22

1332 1331

| ΔS | | | | | | | | | | | | | | | | | | | | | | |
|---|---|---|---|---|---|---|---|---|---|---|---|---|---|---|---|---|---|---|---|---|---|---|
| -1 | 59 | 0 | 1 | 2 | 3 | 4 | 5 | 6 | 7 | 8 | 9 | 10 | 11 | 12 | 13 | 14 | 15 | 16 | 17 | 18 | 19 | 20 |
| 0 | 0 | 1 | 2 | 3 | 4 | 5 | 6 | 7 | 8 | 9 | 10 | 11 | 12 | 13 | 14 | 15 | 16 | 17 | 18 | 19 | 20 | 21 |
| 1 | 1 | 2 | 3 | 4 | 5 | 6 | 7 | 8 | 9 | 10 | 11 | 12 | 13 | 14 | 15 | 16 | 17 | 18 | 19 | 20 | 21 | 22 |

1340

FIG. 13E

N=23

| ΔS | | | | | | | | | | | | | | | | | | | | | | | |
|---|---|---|---|---|---|---|---|---|---|---|---|---|---|---|---|---|---|---|---|---|---|---|---|
| -1 | 59 | 0 | 1 | 2 | 3 | 4 | 5 | 6 | 7 | 8 | 9 | 10 | 11 | 12 | 13 | 14 | 15 | 16 | 17 | 18 | 19 | 20 | 21 |
| 0 | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 |
| 1 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |

FIG. 16

| RANGE OF NUMBER I OF SAMPLES | $BER_{max}(I)$ |
|---|---|
| : | : |
| 40≦I<80 | 0. 1 |
| 80≦I<120 | 0. 125 |
| 120≦I<160 | 0. 175 |
| 160≦I<200 | 0. 194 |
| 200≦I<240 | 0. 21 |
| : | : |

FIG. 17A DCF77:f=77.7kHz
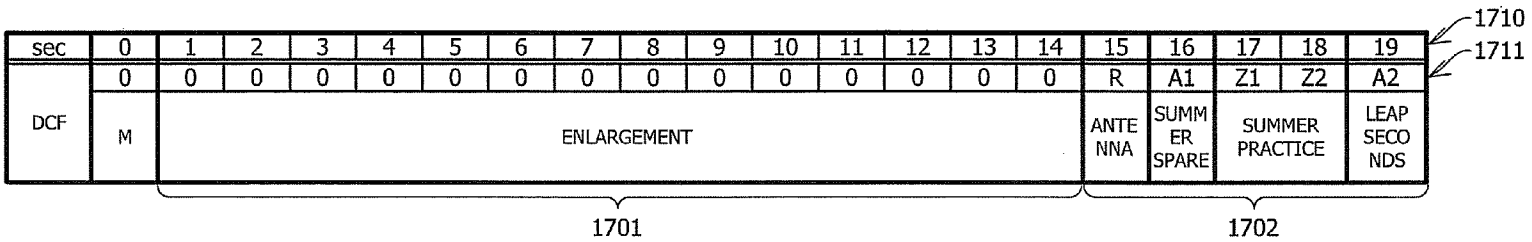
FIG. 17B
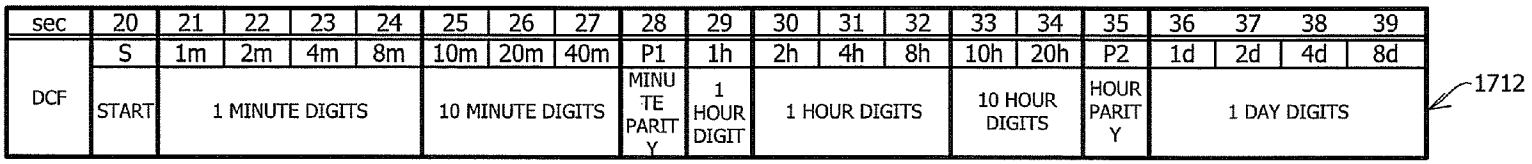
FIG. 17C
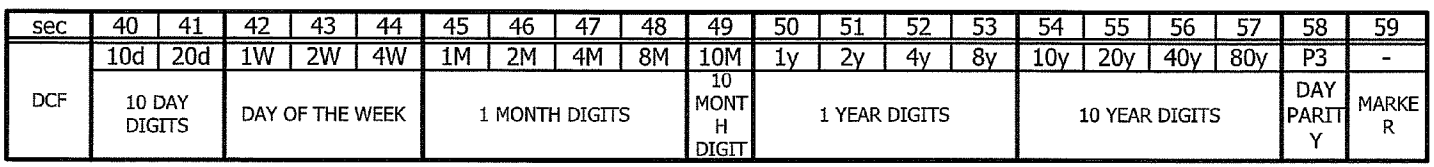

FIG. 18A

1800

1803

| TIME CORRECTING RANGE(ΔS) | CALCULATION-WAVEFORM DATA PATTERN | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 |
| -5 | 55 | 56 | 57 | 58 | 59 | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
| -4 | 56 | 57 | 58 | 59 | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| -3 | 57 | 58 | 59 | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 |
| -2 | 58 | 59 | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 |
| -1 | 59 | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 |
| 0 | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 |
| 1 | 0 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 |
| 2 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 |
| 3 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
| 4 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 |
| 5 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 |

1801

FIG. 18B

1810

1804

| TIME CORRECTING RANGE(ΔS) | CALCULATION-WAVEFORM DATA PATTERN | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 |
| -5 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 |
| -4 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 |
| -3 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 |
| -2 | 19 | 20 | 21 | 22 | 23 | 24 | 25 | 26 | 27 | 27 | 29 | 30 | 31 | 32 | 33 | 34 | 35 | 36 | 37 | 38 | 39 | 40 | 41 | 42 | 43 | 44 | 45 | 46 | 47 | 48 |
| -1 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 |
| 0 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 |
| 1 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 |
| 2 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 |
| 3 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 |
| 4 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 |
| 5 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 |

1802

FIG. 20

2001

| TIME CORRECTING RANGE(Δ S) | CALCULATION-WAVEFORM DATA PATTERN | | | | | | | | | | | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 |
| -8 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 |
| -7 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 |
| -6 | 15 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 |
| -5 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 |
| -4 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 |
| -3 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 |
| -2 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 |
| -1 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 |
| 0 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 |
| 1 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 |
| 2 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 |
| 3 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 |
| 4 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 |
| 5 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 |
| 6 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 | 6 |
| 7 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 | 6 | 7 |
| 8 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 | 6 | 7 | 8 |

2002 2000

FIG. 21

2101

| TIME CORRECTING RANGE(Δ S) | CALCULATION-WAVEFORM DATA PATTERN | | | | | | | | | | | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 |
| -8 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 |
| -7 | 15 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 |
| -6 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 |
| -5 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 |
| -4 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 |
| -3 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 |
| -2 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 |
| -1 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 |
| 0 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 |
| 1 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 |
| 2 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 |
| 3 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 |
| 4 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 |
| 5 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 | 6 |
| 6 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 | 6 | 7 |
| 7 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 | 6 | 7 | 8 |
| 8 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 | 6 | 7 | 8 | 9 |

2100

2102

FIG. 22

2201

| TIME CORRECTING RANGE(Δ S) | CALCULATION-WAVEFORM DATA PATTERN | | | | | | | | | | | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 |
| -8 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 |
| -7 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 |
| -6 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 |
| -5 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 |
| -4 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 |
| -3 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 |
| -2 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 |
| -1 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 |
| 0 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 |
| 1 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 |
| 2 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 | 6 |
| 3 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 | 6 | 7 |
| 4 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 | 6 | 7 | 8 |
| 5 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 | 6 | 7 | 8 | 9 |
| 6 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 | 6 | 7 | 8 | 9 | 10 |
| 7 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 | 6 | 7 | 8 | 9 | 10 | 11 |
| 8 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 0 | 1 | 2 | 3 | 4 | 5 | 6 | 7 | 8 | 9 | 10 | 11 | 12 |

2200

2202

TIME-INFORMATION OBTAINING APPARATUS AND RADIO-CONTROLLED TIMEPIECE

BACKGROUND OF THE INVENTION

The present invention relates to a time-information obtaining apparatus for receiving a standard-time radio wave to obtain time information, and a radio-controlled timepiece installed with the time-information obtaining apparatus.

At present, in Japan, Germany, Great Britain and Switzerland, time-information radio waves in a low frequency band are transmitted from relevant signal stations. For example, in Japan two amplitude-modulated time-information radio waves are transmitted with a frequency 40 kHz and 60 kHz respectively from signal stations in Fukushima and Saga Prefecture. The time-information radio waves (hereinafter, referred to as the "standard-time radio wave") include a sequence of codes composing the time code representing time information. The time information contains information of year, month, date, time, and minutes. The standard-time radio wave is transmitted at a cycle of 60 sec. In other words, the period of the time code is 60 sec.

Now, timepieces (radio-controlled timepieces) are practically used, which receive the standard-time radio wave including the time code and detect the time code from the received standard-time radio wave to correct the time to display thereon. A receiving circuit of the radio-controlled timepiece includes a band pass filter (BPF) for receiving the radio waves through an antenna and obtaining only the standard-time radio wave signal, a demodulating circuit for performing an envelop demodulation on the amplitude-modulated standard-time radio wave signal to demodulate the time signal, and a processing circuit for reading a time code from the time signal.

A conventional processing circuit synchronizes the time signal at its rising edge to sample the same time signal at a predetermined sampling intervals, thereby obtaining a sequence of binary bits, that is, time-code output (TCO) data of a unit time length (1 second). Further, the processing circuit measures pulse widths of TCO data (time of bits "1" and time of bits "0") to determine whether each code is a code "1", a code "0" or a position marker code "P". Then, the processing circuit obtains the time information from the sequence of determined codes.

The conventional processing circuit performs a second-synchronization process, a minute-synchronization process, a code obtaining process, and a consistency judgment process before obtaining the time information from the received standard-time radio wave. When each of the processes has not been finished properly, the processing circuit is required to perform these processes from the very beginning. Therefore, the noise involved in the time signal often requires the processing circuit to perform the processes from the very beginning, and sometimes the processing circuit takes an extremely long time to obtain the time information.

Second-synchronization is to detect rising edges of codes contained in TCO data and coming every one second. And minute-synchronization is to specify the leading position of a minute. In the data in conformity with JJY, the leading position of a minute can be found by detecting a sequence of the position marker PO disposed at the tail of a frame and a marker M disposed at the leading position of the following frame. Since the leading position of the frame can be recognized in the minute synchronization, a reading operation of codes starts. When data for one frame has been read, a parity is checked with respect to the data to judge whether the data shows an impossible value or not (consistency judgment). For example, a value indicating an impossible date (year, month, date, time, minute) is the impossible value. Since the minute synchronization is to specify the leading position of the frame, sometimes it takes 60 seconds. Off course, to detect the leading positions of minutes over several frames, it will take several times longer.

An apparatus disclosed in Japanese Patent 2005-249632 A (US Patent 2005/0195690 A1) samples a demodulated signal at a predetermined sampling intervals (50 ms) to obtain binary TCO, and generates a list of data groups consisting of a sequence of binary bits appearing 20 samples per second. In the apparatus disclosed in Japanese Patent 2005-249632 A (US Patent 2005/0195690 A1), the sequence of binary bits is compared with a template of a sequence of binary bits representing position markers P, a template of a sequence of binary bits representing codes 1, and a template of a sequence of binary bits representing codes 0 to obtain correlations between them, and it is judged based on the obtained correlations, whether the sequence of bits corresponds to the marker P, the code "1", or the code "0".

Further, in the apparatus disclosed in Japanese Patent 2005-249632 A (US Patent 2005/0195690 A1), the sequence of binary bits, that is, TCO data is obtained, and a matching of TCO data with the templates is executed. In the case of poor magnetic field intensity or in the case where the demodulated signal involves many noises, the obtained TCO data can invite many errors. Therefore, it is required to make a fine adjustment of a filter for removing noises from the demodulated signal and of a threshold of A/D converter to enhance a quality of TCO data.

Meanwhile, Japanese Patent 2009-216544 A (US Patent 2009/0231963 A1) discloses a technique, which generates input waveform data for one frame (60 second), and calculation waveform data having the same data length as the input waveform data and corresponding to the present time in accordance with a base time counted by an internal time counter, and compares sample values of the input waveform data with corresponding sample values of the calculation waveform data to calculate the number of errors. In the technique disclosed by Japanese Patent 2009-216544 A (US Patent 2009/0231963 A1), the calculation waveform data is shifted by one bit, and the sample values of the input waveform data and the sample values of the calculation waveform data shifted successively are compared. The comparison of the sample values is implemented 60 times, and the number of errors is counted with respect to each piece of calculation waveform data to find the calculation waveform data having the least number of errors from among the plural pieces of calculation waveform data. And the difference from the base time is calculated from the number of shifts of the found calculation waveform data.

The technique disclosed in Japanese Patent 2009-216544 A (US Patent 2009/0231963 A1) needs the input waveform data for 60 seconds. Further, the technique is required to generate 60 sorts of calculation waveform data and to compare the sample values of the input waveform data with the sample values of the calculation waveform data. Therefore, the technique invites a problem that needs a long time to perform the process for obtaining the input waveform data and for comparing the sample values of the data. Since the radio wave receiving condition is not always kept constant, it is preferable to receive the standard-time radio wave for obtaining the input waveform data within a short period of time.

The present invention is to provide the time-information obtaining apparatus and radio-controlled timepiece, which are capable of obtaining the present time based on the standard-time radio wave within a short period of time and with a high degree of accuracy.

SUMMARY OF THE INVENTION

According to one aspect to the present invention, there is provided a time-information obtaining apparatus, which comprises a receiving unit for receiving a standard-time radio wave to obtain and output a time signal, which includes a time code comprising plural bits, an input waveform data pattern generating unit for sampling the time signal output from the receiving unit to generate an input waveform data pattern, an internal time counting unit with a built-in clock signal generator, for counting a base time based on a clock signal; a calculation-waveform data pattern generating unit for generating plural calculation-waveform data patterns having the same time length as the input waveform data pattern based on the base time counted by the internal time counting unit, an error detecting unit for comparing sample values of the input waveform data pattern with sample values of the plural calculation-waveform data patterns to detect discrepancies between the input waveform data pattern and the calculation-waveform data patterns, thereby obtaining a number of errors between the input waveform data pattern and each of the plural calculation-waveform data patterns, wherein the number of errors represents a number of discrepancies, and a present-time correcting unit for correcting the base time counted by the internal time counting unit based on the calculation-waveform data pattern having a smallest number of errors, wherein the error detecting unit comprises an invalid-bit detecting unit for detecting, among bits of the plural calculation-waveform data patterns, invalid bits having sample values not to be compared with the input waveform data pattern, and an error counting unit for comparing the sample values of valid bits of the plural calculation-waveform data patterns having the invalid bits removed with the sample values of the corresponding bits of the input waveform data pattern to detect the discrepancies.

According to another aspect of the invention, there is provided another time-information obtaining apparatus, which comprises a receiving unit for receiving a standard-time radio wave to obtain and output a time signal, which includes a time code comprising plural bits, an input waveform data pattern generating unit for sampling the time signal output from the receiving unit to generate an input waveform data pattern, an internal time counting unit with a built-in clock signal generator, for counting a base time based on a clock signal, a calculation-waveform data pattern generating unit for generating plural calculation-waveform data patterns having the same time length as the input waveform data pattern based on the base time counted by the internal time counting unit, an error detecting unit for comparing sample values of the input waveform data pattern with sample values of the plural calculation-waveform data patterns to detect discrepancies between the input waveform data pattern and the calculation-waveform data patterns, thereby obtaining a number of errors between the input waveform data pattern and each of the plural calculation-waveform data patterns, wherein the number of errors represents a number of discrepancies, a present-time correcting unit for correcting the base time counted by the internal time counting unit based on the calculation-waveform data pattern having a smallest number of errors, a calculation-waveform data pattern determining unit for determining respective starting positions of the plural calculation-waveform data patterns such that a number of invalid bits not to be compared among bits of the plural calculation-waveform data patterns will be less than a predetermined number, and an input waveform data pattern determining unit for determining a starting position of the input waveform data pattern so as to conform to the starting positions determined by the calculation-waveform data pattern determining unit.

BRIEF DESCRIPTION OF THE DRAWINGS

FIG. 9A, FIG. 9B and FIG. 9C are views for explaining functions of bits of the signal of the standard-time radio wave in conformity with JJY.

FIG. 11A, FIG. 11B, FIG. 11C, FIG. 11D, and FIG. 11E are views illustrating examples of the calculation-waveform data patterns, which originally have 19, 20, 21, 22 and 23 bits, respectively (original bit numbers N=19, 20, 21, 22 and 23).

FIG. 12A, FIG. 12B, FIG. 12C, FIG. 12D, and FIG. 12E are views illustrating examples of the calculation-waveform data patterns, which originally have 19, 20, 21, 22 and 23 bits, respectively (original bit numbers N=19, 20, 21, 22 and 23), the number of invalid bits, the number of valid bits, and the number of valid bits after adjustment.

FIG. 13A, FIG. 13B, FIG. 13C, FIG. 13D and FIG. 13E are views illustrating the valid bits of the calculation-waveform data patterns shown in FIG. 11A, FIG. 11B, FIG. 11C, FIG. 11D, and FIG. 11E, which have been adjusted.

FIG. 16 is a view illustrating an example of a maximum allowable BER table in the first embodiment of the invention.

FIG. 17A, FIG. 17B, and FIG. 17C are views illustrating functions of bits of the standard-time radio wave signal in conformity with DCF77.

FIG. 18A and FIG. 18B are views illustrating examples of the calculation-waveform data patterns based on the standard-time radio wave signal in conformity with DCF77.

FIG. 20 is a view for explaining the starting time and bit length of the calculation-waveform data in the second embodiment of the invention.

FIG. 21 is a view for explaining the starting time and bit length of the calculation-waveform data in the second embodiment of the invention.

FIG. 22 is views for explaining the starting time and bit length of the calculation-waveform data in the second embodiment of the invention.

DESCRIPTION OF THE PREFERRED EMBODIMENTS

Now, the embodiments of the present invention will be described in detail with reference to the accompanying drawings. In the embodiments of the present invention, radio-controlled timepieces are provided with a time-information obtaining apparatus according to the present invention. The radio-controlled timepieces receive a radio wave carrying a standard time in a low frequency band, detects a time signal, decodes a sequence of codes representing a time code involved in the detected time signal, and displays the exact time based on the sequence of codes.

Currently in Japan, Germany, Great Britain and Switzerland, the time-information radio waves are transmitted from the relevant signal stations. For example, in Japan two amplitude-modulated time-information radio waves are transmitted with a frequency 40 kHz and 60 kHz respectively from the signal stations in Fukushima and Saga Prefecture. The time-information radio waves (hereinafter, referred to as the "standard-time radio wave") include a sequence of codes composing the time code representing time information, which contains year, month, time, minutes and so on, and are transmitted at a cycle of 60 sec. Since one bit indicating one code has a unit time length (1 sec.), one cycle contains 60 codes.

Figure 1:
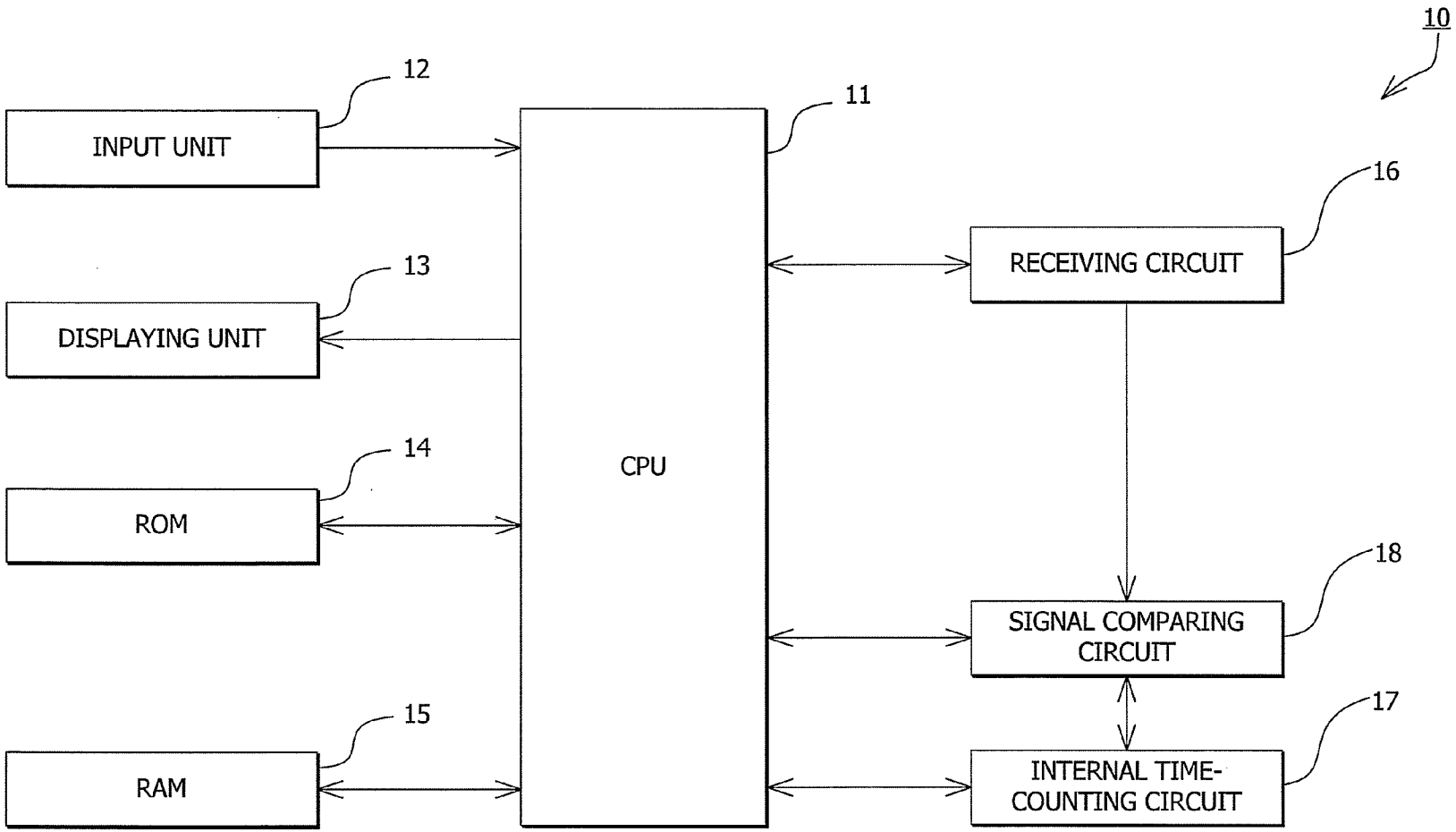
FIG. 1 is a block diagram illustrating a configuration of a radio-controlled timepiece according to the first embodiment of the invention.

FIG. 1 is a block diagram illustrating a configuration of a radio-controlled timepiece 10 according to the first embodiment of the invention. As shown in FIG. 1, the radio-controlled timepiece 10 comprises CPU (present-time correcting unit) 11, an input unit 12, a displaying unit 13, ROM 14, RAM 15, a receiving circuit (receiver unit) 16, an internal time-counting circuit (built-in time-counting unit) 17, and a signal comparing circuit 18.

CPU 11 reads a program stored in ROM 14 at a predetermined timing or in response to an operation signal input from the input unit 12 and expands the read program on RAM 15, and gives instructions and/or transfers data to various units of the timepiece 10 in accordance with the program. More specifically, CPU 11 performs various processes, including a process of transferring a base time BT to the displaying unit 13 and a process of correcting the base time BT, wherein CPU 11 controls the receiving circuit 16 to receive the standard-time radio wave every certain periods of time, detects digital data contained in the signal received by the receiving circuit 16, and specifies a sequence of codes contained in the signal of the standard-time radio wave based on the detected digital data, and further controls the internal time-counting circuit 17 to obtain the base time BT from the sequence of codes.

In the present embodiment of the invention, as will be described later, a time, that is, the base time BT obtained or counted by the internal time-counting circuit 17 is used to specify a time "Now" of starting a process, and plural calculation-waveform data patterns having an unit time of longer than 1 are generated with a starting time, which will reach the specified time "Now" before or after a predetermined time. Each of the plural calculation-waveform data patterns is compared to an input waveform data pattern generated from a waveform of the received signal.

As a result of comparison of the data patterns, the codes involved in the received signal are specified, and a difference between the base time BT and the time determined based on the received signal is calculated, and using the calculated difference, the base time BT counted by the internal time-counting circuit 17 is corrected.

The input unit 12 has switches for giving instructions to perform various functions of the radio-controlled timepiece 10. When one of switches of the input unit 12 is operated, an operation signal corresponding to the operated switch is output to CPU 11. The displaying unit 13 includes a dial plate, an analog indicator mechanism controlled by CPU 11, and a liquid crystal display panel, and displays the time in accordance with the base time BT counted by the internal time-counting circuit 17. ROM 14 stores a system program and application programs for operating the radio-controlled timepiece 10 and/or for realizing predetermined functions. Also in the program for realizing predetermined functions is included a program for controlling the signal comparing circuit 18 to execute various processes including a process of detecting a position of a second pulse, a process of comparing the calculation-waveform data patterns with the input waveform data pattern, a process of detecting a leading position of "minute", and a process of decoding codes. RAM 15 is used as a work area of CPU 11, and temporarily stores the program and data read from ROM 14, and data processed by CPU 11.

The receiving circuit 16 includes an antenna circuit and a detecting circuit, and obtains a signal demodulated from the standard time radio wave received by the antenna circuit and supplies the same signal to the signal comparing circuit 18. The internal time-counting circuit 17 includes an oscillation circuit, and counts clock signals output from the oscillation circuit to count the base time, thereby determining a time, and then supplies data of the time (time data) to CPU 11.

Figure 2:
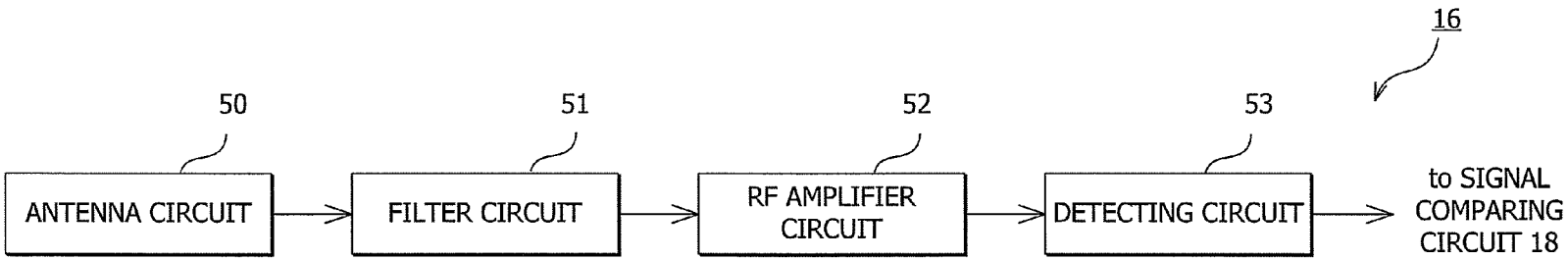
FIG. 2 is a block diagram illustrating a configuration of a receiving circuit in the first embodiment of the invention.

FIG. 2 is a block diagram illustrating a configuration of the receiving circuit 16 in the first embodiment of the invention. As shown in FIG. 2, the receiving circuit 16 is provided with an antenna circuit 50, a filter circuit 51, RF amplifier circuit 52, and a detecting circuit 53. The antenna circuit 50 receives the standard-time radio wave, the filter circuit 51 removes noises involved in the signal of the standard-time radio wave received by the antenna circuit 50, RF amplifier circuit 52 amplifies a high frequency signal supplied from the filter circuit 51, and the detecting circuit 53 detects the high frequency signal supplied from RF amplifier 52, thereby demodulating the standard-time radio wave signal. The standard-time radio wave signal demodulated by the detecting circuit 53 is supplied to the signal comparing circuit 18.

Figure 3:
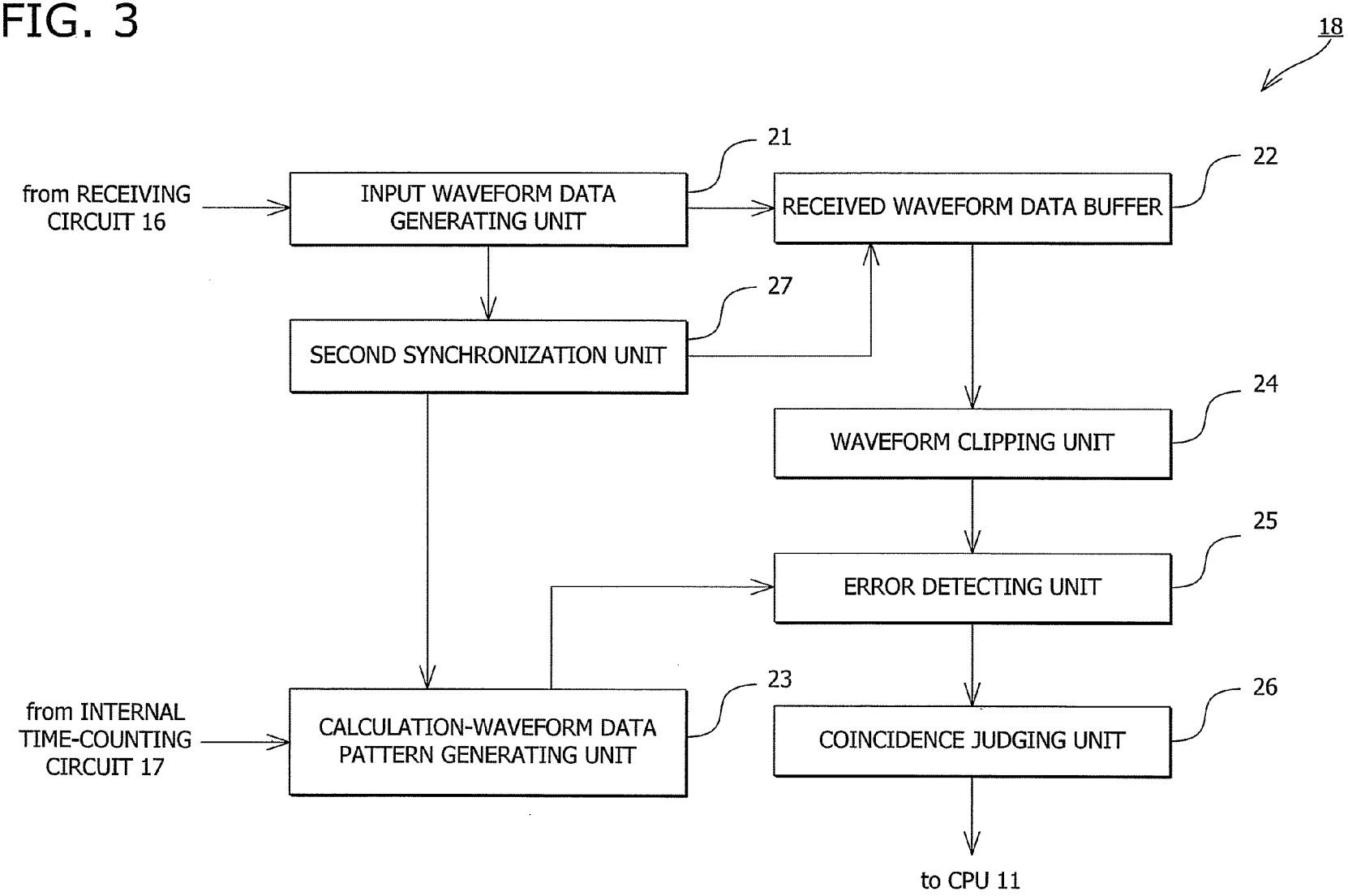
FIG. 3 is a block diagram illustrating a configuration of a signal comparing circuit in the first embodiment of the invention.

FIG. 3 is a block diagram illustrating a configuration of the signal comparing circuit 18 in the first embodiment of the invention. As shown in FIG. 3, the signal comparing circuit 18 has an input waveform data generating unit (input waveform data pattern generating unit) 21, a received waveform data buffer 22, a calculation-waveform data pattern generating unit 23, a waveform clipping unit (input waveform data pattern generating unit) 24, an error detecting unit 25, a coincidence judging unit (current time correcting unit) 26, and a second synchronization unit 27.

The input waveform data generating unit 21 subjects the signal output from the receiving circuit 16 (detecting circuit 53) to a sampling process with a predetermined sampling interval to convert into digital data having a value, wherein the value takes either one of plural values (0 or 1). In the first embodiment of the invention, for example, the above sampling interval is 50 ms. and 20 samples of data per second can be obtained. The received waveform data buffer 22 successively stores data generated by the input waveform data generating unit 21. The received waveform data buffer 22 is able to store data having plural unit time lengths (fore example, data having a time length of 40 seconds), wherein the unit time length is 1 second. When new data is stored in the received waveform data buffer 22, data previously stored is deleted in chronological order.

After the leading positions of "second" are decided in the second-synchronization by the second synchronization unit 27, the input waveform data generating unit 21 generates sample values D(n) of the input waveform data every one code from the leading position of "second". In this case, for example, data falling in a predetermined time interval (500 ms to 800 ms) is obtained out of values obtained every predetermined sampling intervals, and it is judged which data value 1 or 0 is found more in such data, whereby the sample values D(n) of the input waveform data with respect to each second can be obtained.

In the first embodiment of the invention, code data of one bit, generated by the input waveform data generating unit 21 is referred to as the "input waveform data", and the value of the code data is referred to as a "sample value". Code data of several bits obtained over a period of predetermined seconds is referred to as an "input waveform data pattern". Further, in the calculation-waveform data pattern generating unit 23 to be described hereinafter, the code data of one bit and code data of several bits are referred to as "calculation-waveform data" and a "calculation-waveform data pattern", respectively.

The calculation-waveform data pattern generating unit 23 generates plural calculation-waveform data patterns to be compared with the input waveform data pattern. The plural calculation-waveform data patterns will be described in detail later. The waveform clipping unit 24 takes out the input waveform data pattern having the same time length as the calculation-waveform data patterns from the received waveform data buffer 22.

Figure 8A:
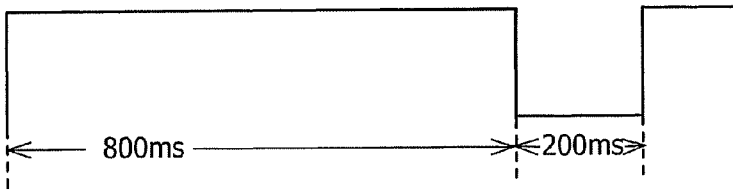
FIG. 8A, FIG. 8B, and FIG. 8C are views illustrating codes in the standard-time radio wave in conformity with JJY in more detail.
Figure 8B:
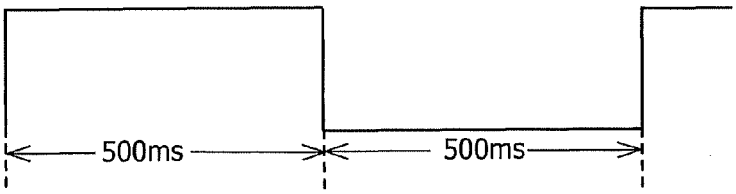
Figure 8C:
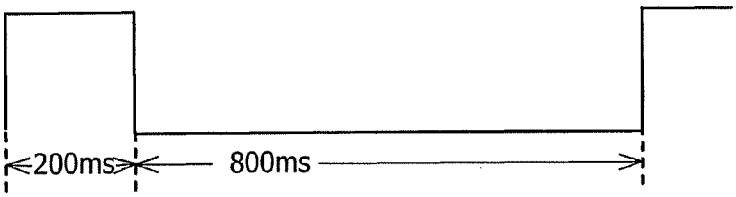

Using a well known conventional method, the second synchronization unit 27 detects the leading position of "second" in the input waveform data generated by the input waveform data generating unit 21. For instance, in the standard-time radio wave in conformity with JJY, every code rises at the leading position of "second" as illustrated in FIG. 8A, FIG. 8B, and FIG. 8C. Therefore, it is possible to detect the leading position of "second" by detecting the rising of the code.

The error detecting unit 25 counts the number of errors representing non-coincidence between the plural calculation-waveform data patterns and the input waveform data pattern. As described above, the input waveform data pattern has the sample values D(n) of bits composing the input waveform data pattern per second. Also, the calculation-waveform data pattern has sample values P(n) of bits composing the calculation-waveform data pattern per second. Therefore, the sample values D(n) of the input waveform data pattern are compared with the corresponding sample values P(n) of the calculation-waveform data pattern, and when it is arranged such that, when they do not agree with each other, the number of errors is counted up by "1", then it will be possible to count the number of errors.

Figure 4:
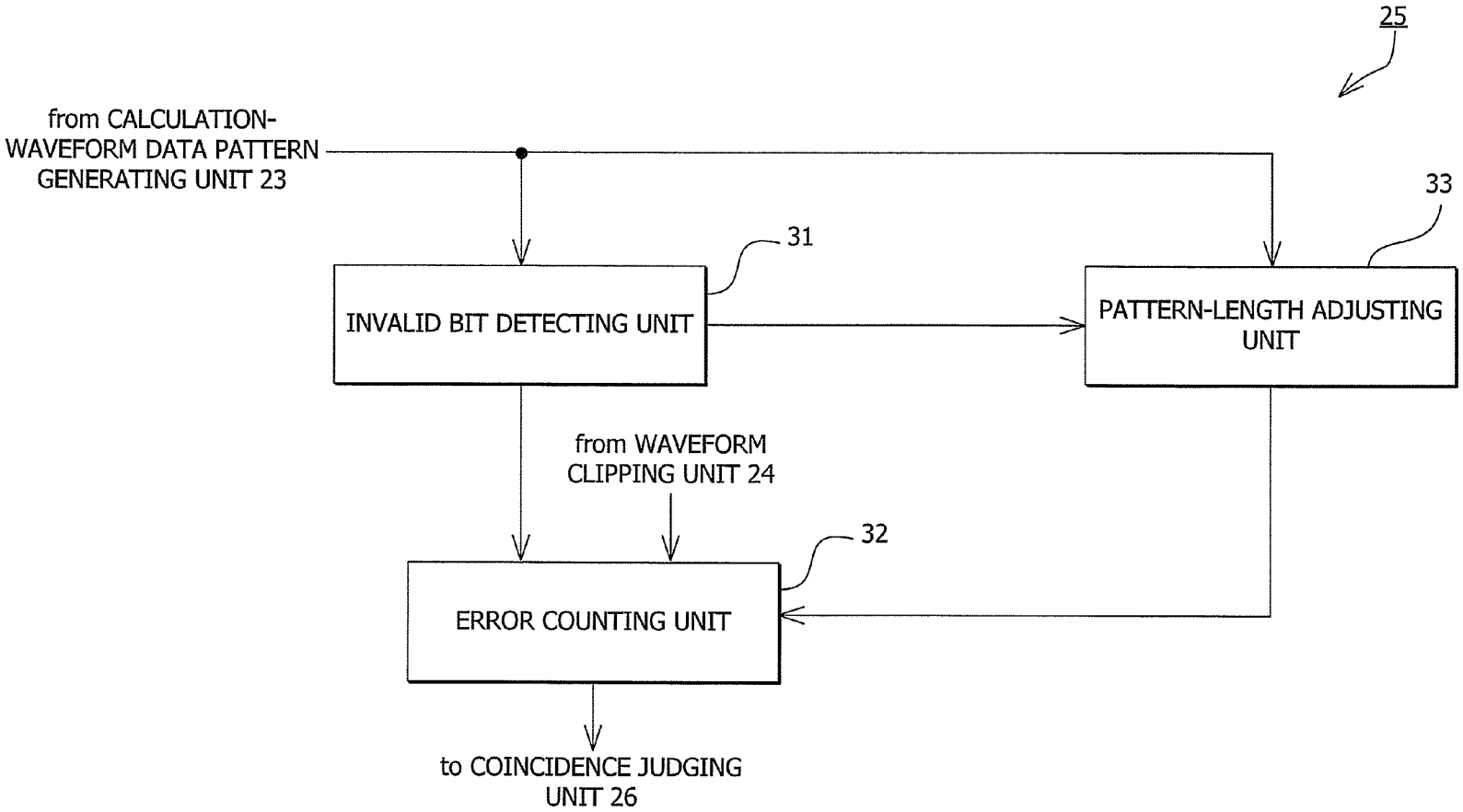
FIG. 4 is a block diagram illustrating a configuration of an error detecting unit in the first embodiment of the invention.

FIG. 4 is a block diagram illustrating a configuration of the error detecting unit 25 in the first embodiment of the invention. As shown in FIG. 4, the error detecting unit 25 comprises an invalid bit detecting unit 31, an error counting unit 32 and a pattern-length adjusting unit (bit-number adjusting unit) 33. The invalid bit detecting unit 31 detects invalid bits in the calculation-waveform data patterns, which are not to be compared with the sample values of the input waveform data pattern clipped by the waveform clipping unit 24. The error counting unit 32 counts the number of errors based on a result of the comparison of the sample values of not invalid bits (valid bits) in the calculation-waveform data patterns with the sample values of the input waveform data pattern. In other words, the error counting unit 32 detects discrepancies between the calculation-waveform data patterns and the input waveform data pattern. The pattern-length adjusting unit 33 adjusts the lengths of the plural calculation-waveform data patterns such that each calculation-waveform data pattern contains the same number of valid bits. The processes performed by these units 31, 32 and 33 will be described later, again.

The coincidence judging unit 26 calculates a bit error rate (BER) based on the error number with respect to each of the plural calculation-waveform data patterns, and specifies the calculation-waveform data pattern, which coincides with the input waveform data pattern, based on the calculated BER.

Figure 5:
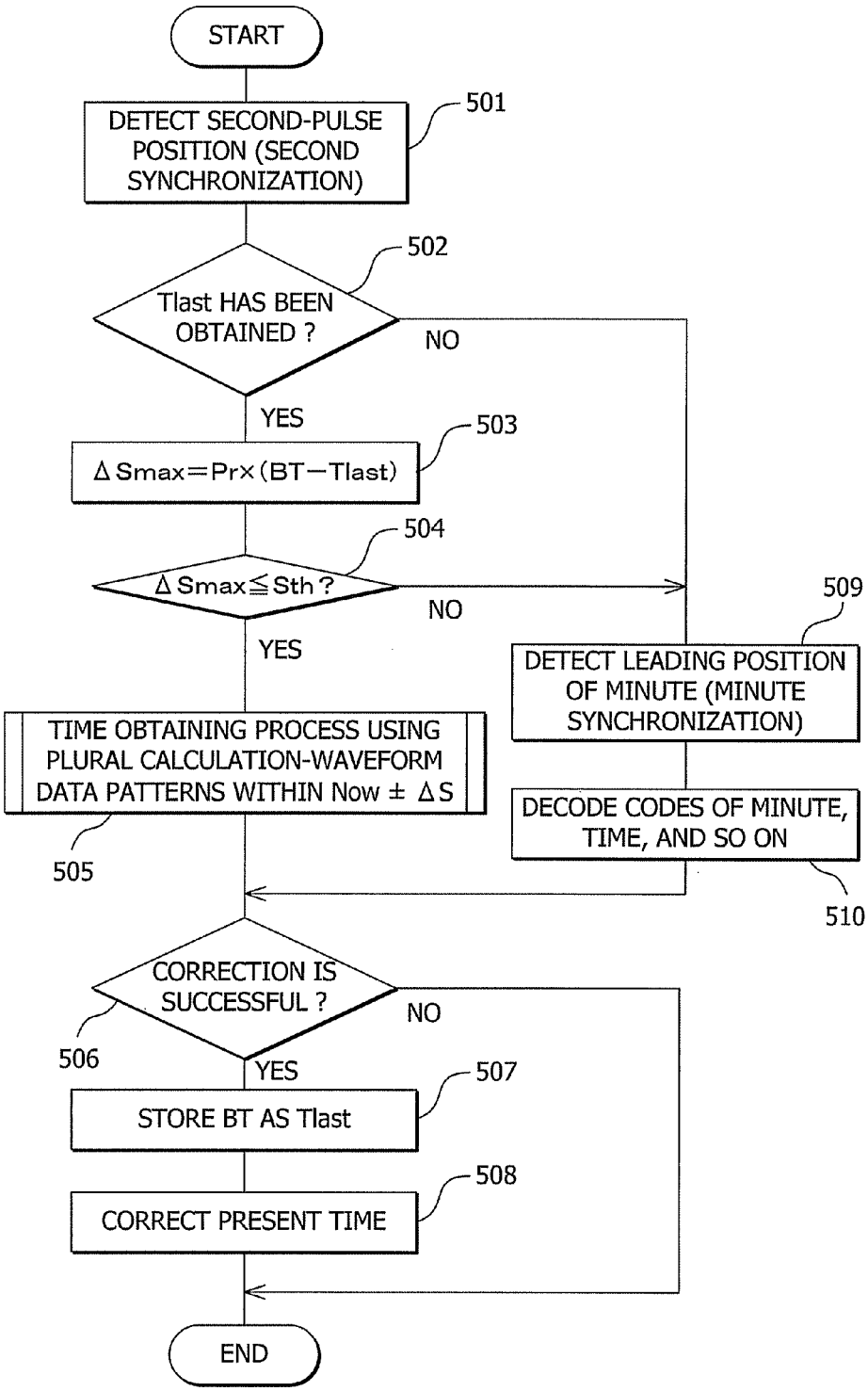
FIG. 5 is a flow chart illustrating an overview of a process performed in the radio-controlled timepiece according to the first embodiment of the invention.
Figure 6:
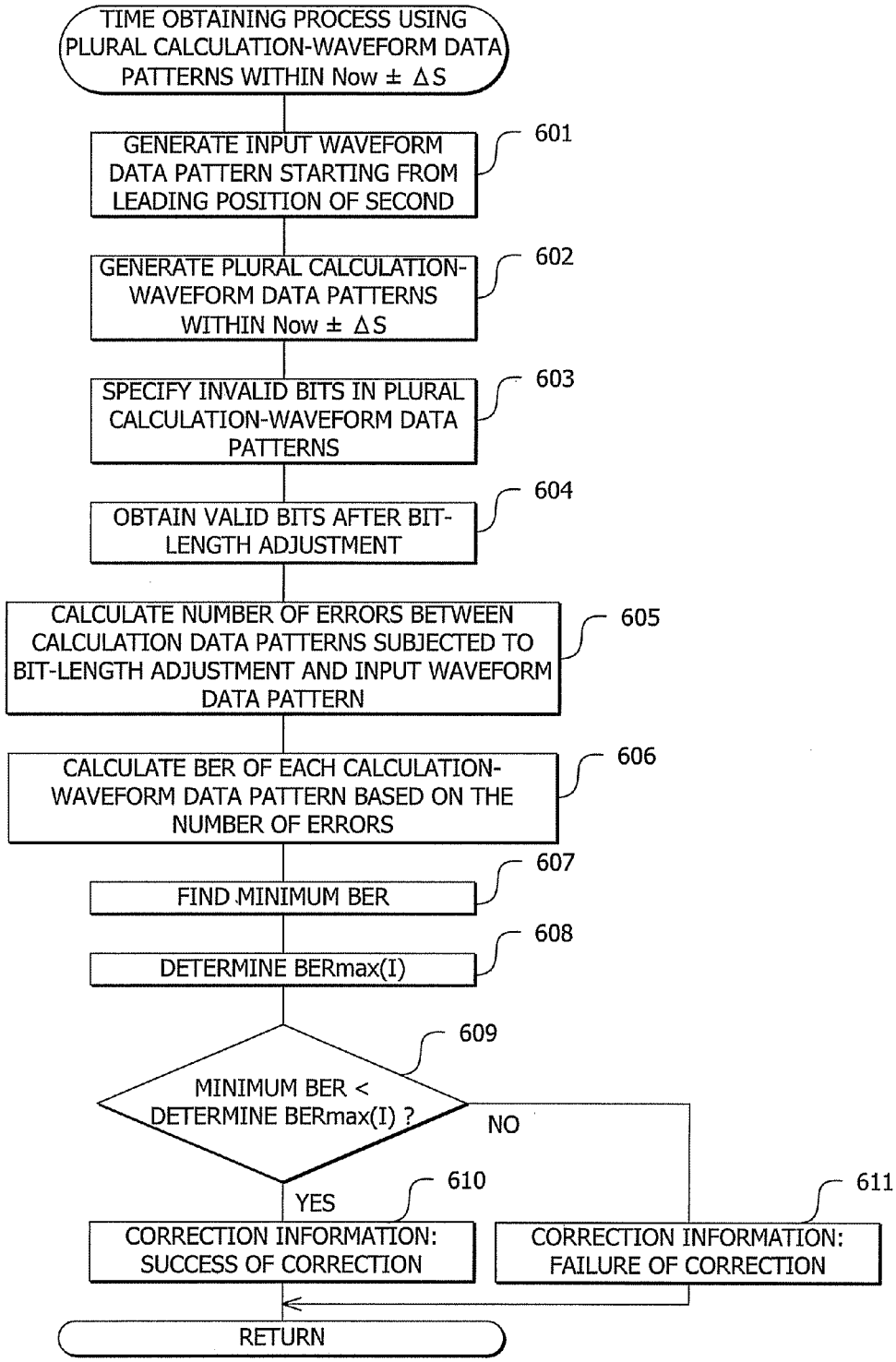
FIG. 6 is a flow chart illustrating a process at step 505 of FIG. 5 in more detail.

FIG. 5 is a flow chart illustrating an overview of a process performed in the radio-controlled timepiece 10 according to the present embodiment. FIG. 6 is a flow chart illustrating a process at step 505 of FIG. 5 in more detail. The process shown in FIG. 5 is performed mainly by CPU 11 and the signal comparing circuit 18. The signal comparing circuit 18 works in accordance with the instructions given by CPU 11. Second-pulse positions are detected by CPU 11 and the signal comparing circuit 18 at step 501. A process for detecting second-pulse position is referred to as a "second-synchronization".

The second-synchronization is performed by the second synchronization unit 27 of the signal comparing circuit 18, for example, using a well known conventional method. In the second-synchronization, the leading position of "second" in the input waveform data is specified, and a time difference $\Delta t$ between the leading of the input waveform data and specified leading position of "second" is obtained.

Figure 7A:
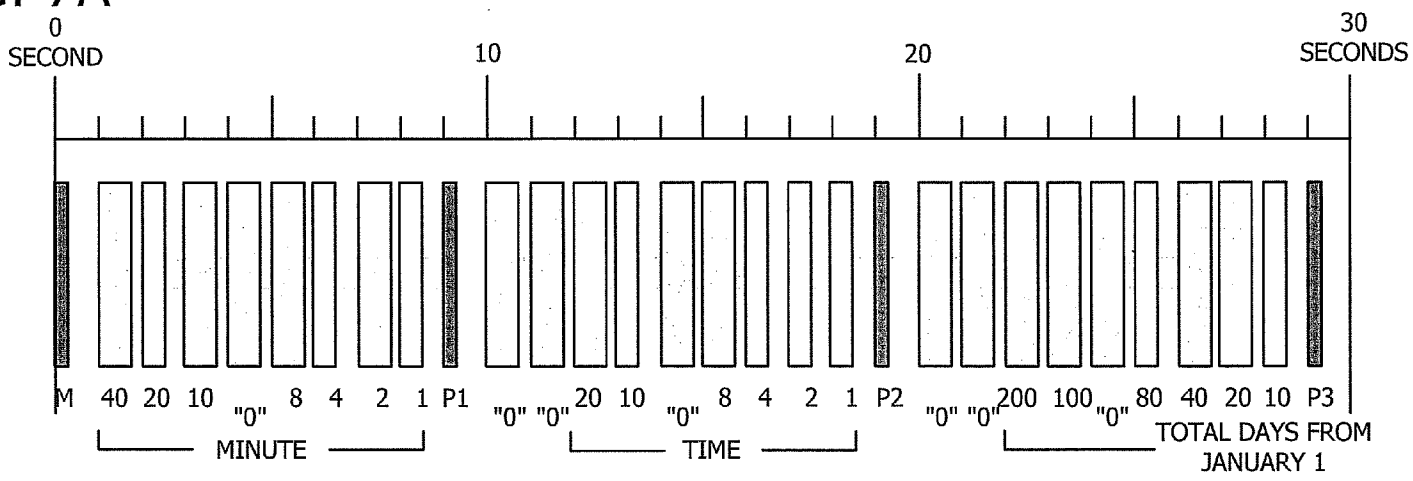
FIG. 7A and FIG. 7B are views illustrating examples of standard-time radio waves in conformity with JJY, respectively.
Figure 7B:
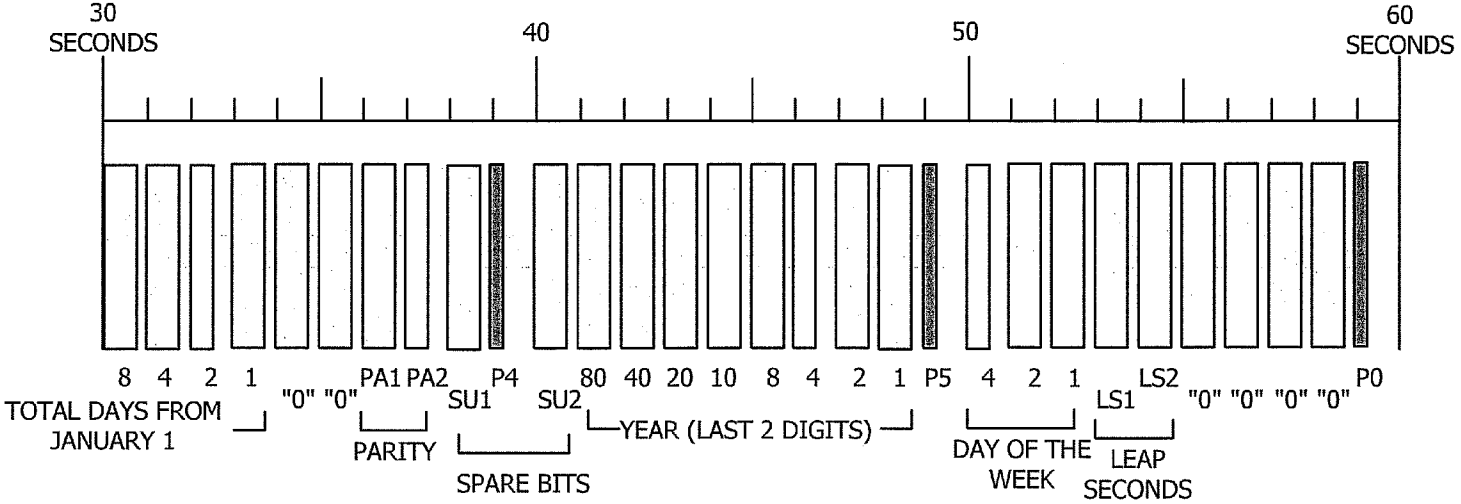

FIG. 7A and FIG. 7B are views illustrating examples of the standard-time radio waves in conformity with JJY, respectively. As shown in FIG. 7A and FIG. 7B, in the standard-time radio wave in conformity with JJY, codes of JJY are transmitted in the determined order. In the standard-time radio wave in conformity with JJY, position marker codes "P" having a unit time length, codes "0" and codes "1" are lined. Further in the standard-time radio wave, one frame is 60 seconds long and contains 60 codes, and the position markers P1, P2, . . . or a marker "M" arrive every 10 seconds. By detecting a portion of a sequence of the position marker "P0" disposed at the tail of a frame and the marker "M" disposed at the leading position of the following frame, the leading positions of the frame, which arrives every 60 seconds, will be found, that is, the leading position of "minute" will be found. The second-synchronization is to find either one of the leading positions of the above 60 codes.

FIG. 8A, FIG. 8B, and FIG. 8C are views illustrating codes in the standard-time radio wave in conformity with JJY in more detail. As shown in FIG. 8A, FIG. 8B, and FIG. 8C, the standard-time radio wave in conformity with JJY contains the position marker codes "P", code "0", and code "1", having a unit time length of 1 sec. The code "0" shown in FIG. 8A keeps high (high level, value 1) in the first period of 800 ms and low (low level, value 0) in the remaining period of 200 ms. The code "1" shown in FIG. 8B keeps high (high level, value 1) in the first period of 500 ms and low (low level, value 0) in the remaining period of 500 ms. The position marker code "P" shown in FIG. 8C keeps high (high level, value 1) in the first period of 200 ms and low (low level, value 0) in the remaining period of 800 ms.

In the standard-time radio wave in conformity with JJY, the code "0" and the code "1" are different in a code level during the time period from 500 ms to 800 ms. In other words, the code "0" is of a high level (value 1) in the time period, and meanwhile the code "0" is of a low level (value 0) in the same time period. In the first embodiment of the invention, the input waveform data generating unit 21 obtains data falling in the above time period, and judges which codes the data contains more, codes of a value "0" or codes of a value "1", thereby obtaining the sample value D(n) of the input waveform data with respect to each second. In the case of a time signal in conformity with other standard, the time period, in which both codes have different code levels, respectively will be different from the above time period. Therefore, it is preferable to change the time period for determining the sample values depending on such standard.

As shown in FIG. 7A and FIG. 7B, the time signal of the standard-time radio wave contains codes representing a date and a time including "minute", "time", "the total days counted from the January 1", "year", "a day of the week" and so on, and further contains enlargement bits to be used in future and given a fixed value "0". At present, bits concerning the practice of Summer Time and bits representing a leap second are not used in the time signal of the standard-time radio wave, but bits to be used in a specified period of time are contained and given specified values. These special bits can be give other values in future, and are referred to as "invalid bits". The invalid bits are those other than the bits, which are assigned with specified values in accordance with the standard and/or given values specified uniquely depending on the date and time (hour, date, month, and year).

FIG. 9A, FIG. 9B and FIG. 9C are views for explaining functions of bits of the time signal of the standard-time radio wave in conformity with JJY. In the tables shown in FIG. 9A, FIG. 9B and FIG. 9C, the top (Reference numeral: 910) indicates a time lapsed since the beginning of second, the middle (Reference numeral: 911) indicates contents of codes, and the bottom (Reference numeral: 912) indicates meanings of values. "Enlargement" (Reference numerals 901, 902) in the bottom indicates enlargement bits. In FIG. 9A, FIG. 9B and FIG. 9C, bits denoted by reference numerals 901 to 908 are invalid bits.

Figures 10A, 10B, 10C, 10D, 10E, 10F:
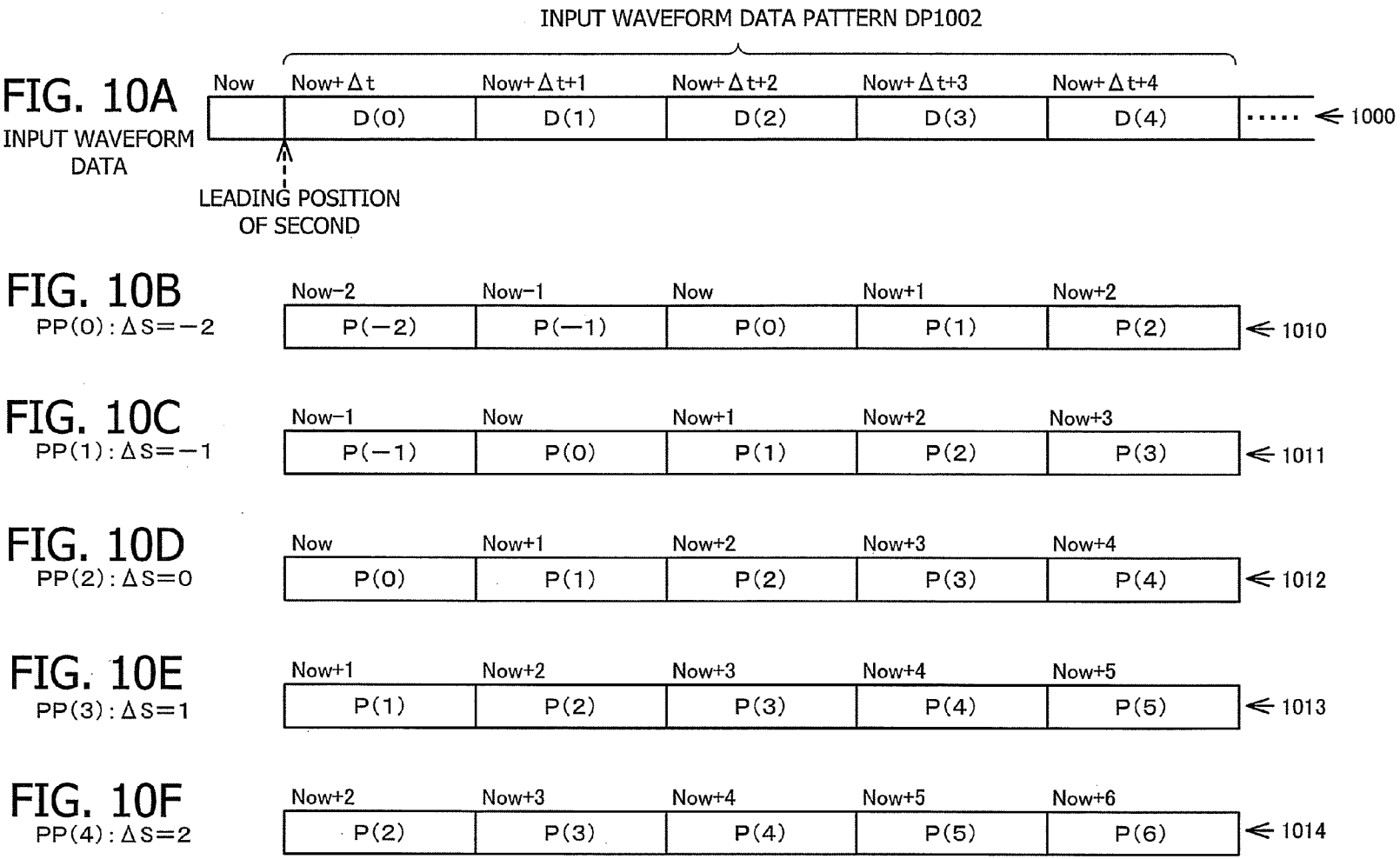
FIG. 10A is a view for explaining input waveform data and an input waveform data pattern in the first embodiment of the invention.
FIG. 10B, FIG. 10C, FIG. 10D, FIG. 10E and FIG. 10F are views for explaining plural calculation-waveform data patterns in the first embodiment of the invention.

FIG. 10A is a view for explaining the input waveform data and the input waveform data pattern in the first embodiment of the invention. FIG. 10B to FIG. 10F are views for explaining plural calculation-waveform data patterns in the first embodiment of the invention. In FIG. 10A, the input waveform data 1000 is shown, which has a process starting time "Now" at the leading position, where a process starts based on the time or the base time BT counted by the internal time-counting circuit 17. The second synchronization unit 27 executes the second-synchronization, thereby representing that the leading position of "second" has come after the process starting time "Now" based on the base time BT by Δt on the time axis. In the input waveform data, data is clipped from said waveform data based on the position corresponding to a time "Now+Δt" and the positions corresponding to times separate from the time "Now+Δt" by the unit of second(s). The time "Now+Δt" is referred to as the "leading time of code". The base time BT is the time counted by the internal time-counting circuit 17 of the radio-controlled timepiece 10 according to the first embodiment of the invention. The process starting time "Now" is the time, at which the receiving circuit 16 has started receiving the standard-time radio wave in accordance with the base time BT.

When the second-synchronization has finished at step 501, then CPU 11 and the signal comparing circuit 18 judge at step 502 whether or not a final correcting time Tlast has been obtained and stored in a predetermined area of RAM 15 at the previous step. The final correcting time Tlast is reset, when the whole operation of the radio-controlled timepiece 10 is reset or when a user corrects the time of the internal time-counting circuit 17 by operating the input unit 12. Accordingly, in these cases, it is determined NO at step 502.

When it is determined at step 502 that the final correcting time Tlast has been obtained and stored in a predetermined area of RAM 15 (YES at step 502), based on a precision Pr of the internal time-counting operation in the radio-controlled timepiece 10, CPU 11 and the signal comparing circuit 18 calculate a supposable error or the maximum supposable error ΔSmax, using the following formula (step 503).

$\Delta Smax = Pr \times (BT - Tlast)$, where (BT−Tlast) represents a period from the time when the time was corrected in the previous process to the base time BT counted by the internal time-counting circuit 17, that is, (BT−Tlast) represents a period, in which the time has not been corrected. In the case that the precision Pr corresponds to a value of ±15 sec/month, if (BT−Tlast)=30 days, ΔSmax will be 15 sec.

Then, it is judged at step 504 whether the maximum supposable error ΔSmax is larger than a threshold value Sth or not. In the first embodiment of the invention, if the precision Pr of the radio-controlled timepiece 10 is ±15 sec/month and the period, in which no time has been corrected, is not more than 30 days (Sth corresponds to 30 days), a time obtaining process using plural calculation-waveform data patterns is performed at step 505. If ΔSmax is expressed in seconds, (2×ΔSmax+1) pieces of calculation-waveform data patterns are generated.

FIG. 6 is the flow chart illustrating the process to be performed at step 505 of FIG. 5 in the first embodiment in more detail. The waveform clipping unit 24 of the signal comparing circuit 18 reads input waveform data from the received waveform data buffer 22 to generate an input waveform data pattern DP having a time length of predetermined seconds starting from the leading position of "second", "Now+Δt", based on the second-synchronization (step 601). In the example shown in FIG. 10A, the input waveform data pattern DP (Reference numeral: 1002) for a period of 5 seconds is shown, containing the sample values D(0), D(1), D(2), D(3) and D(4). In practice, the number N of sample values D(n) (n=0 to N−1) is determined in accordance with a receiving intensity of the standard-time radio wave received by the receiving circuit 16. For instance, it is enough for CPU 11 to decide the number of sample values such that as the receiving intensity of the standard-time radio wave decreases, the number of sample values increases with the smallest number of the sample values set to about N−1=20.

In FIG. 10A, the sample values D(0), D(1), D(2), D(3) and D(4) start from the times, "Now+Δt", "Now+Δt+1", "Now+Δt+2", "Now+Δt+3", and "Now+Δt+4", respectively, and contain codes each representing one bit (0 or 1), respectively.

The calculation-waveform data pattern generating unit 23 generates plural calculation-waveform data patterns having the starting times varying within a range from −ΔS to +ΔS (ΔS≤ΔSmax) with its center at the process starting time "Now" based on the base time BT (step 602). In other words, the calculation-waveform data pattern generating unit 23 generates plural calculation-waveform data patterns having the leading positions of "pattern" at "Now±ΔS", respectively and having the same time length as the input waveform data pattern. Five calculation-waveform data patterns, where ΔSmax=2 sec and ΔS=−2 to +2 have been set, are illustrated in FIG. 10B to FIG. 10F.

As will be described later, when the calculation-waveform data pattern contains invalid bits, such invalid bits are excluded from those to be compared to. Some bits (bits-to-be-removed) are also excluded from those to be adjusted in a bit length adjustment. Therefore, the number of bits in the calculation-waveform data pattern is decreased by the number of bits excluded (invalid bits and bits-to-be-removed). The number of bits of the calculation-waveform data pattern and input waveform data pattern will be described in detail later.

The first calculation-waveform data pattern PP(0) to the fifth calculation-waveform data pattern PP(4) (Reference numerals: 1011 to 1014) have the starting times of "patterns", "Now−2", "Now−1", "Now", "Now+1" and "Now+2", respectively. For instance, the first calculation-waveform data pattern PP(0) consists of a sample value P(-2) corresponding to a code at the time, "Now−2", a sample value P(-1) corresponding to a code at the time, "Now−1", a sample value P(0) corresponding to a code at the time, "Now", a sample value P(1) corresponding to a code at the time, "Now+1", and a sample value P(2) corresponding to a code at the time, "Now+2".

The invalid bit detecting unit 31 of the error detecting unit 25 specifies invalid bits in the calculation waveform data patterns at step 603. FIG. 11A to FIG. 11E are views illustrating examples of the calculation-waveform data patterns, whose original data patterns have the original bit numbers N=19, 20, 21, 22 and 23, respectively. In each of the examples shown in FIG. 11A to FIG. 11E, three calculation-waveform data patterns having the leading times of "second", "Now+ΔS", where ΔS=−1, 0, +1, are shown. For instance, in the example of FIG. 11A, three calculation-waveform data patterns (Reference numeral: 1100) each containing the sample values of 19 bits are shown. The calculation-waveform data pattern of ΔS=0 (Reference numeral: 1102) has the sample values corresponding to the 0-th second code to the 18-th second code, respectively. The calculation-waveform data pattern of ΔS=−1 (Reference numeral: 1101) has the sample values corresponding to the 59-th second code to the 17-th second code. And the calculation-waveform data pattern of ΔS=+1 (Reference numeral: 1103) has the sample values corresponding respectively to the first second code to the 19-th second code.

In FIG. 11A to FIG. 11E, invalid bits are shown in grey. In the example of FIG. 11A, bits corresponding to the fourth second code, the 10-th second code, the 11-th second code and the 14-th second code are invalid bits. In each of the calculation-waveform data patterns shown in FIG. 11A, the invalid bit detecting unit 31 determines the bits at the fourth second, the 10-th second, the 11-th second and the 14-th second as the invalid bits. As shown in FIG. 11A, when the number N of original bits is 19, N=19, each calculation-waveform data pattern contains 4 invalid bits, and therefore, the number of the valid bits contained in each of the calculation-waveform data patterns will be 15.

Meanwhile, there are shown in FIG. 11B three calculation-waveform data patterns (Reference numeral: 1110), and two of them having ΔS=−1 and ΔS=0 contain invalid bits respectively at the fourth second, 10-th second, 11-th second and 14-th second, and the number of invalid bits is 4. The remaining calculation-waveform data pattern having ΔS=1 contain invalid bits at the 20-th second in addition to those at the fourth second, 10-th second, 11-th second and 14-th second, and the number of invalid bits is 5.

In the example shown in FIG. 11C, out of three calculation-waveform data patterns (Reference numeral: 1120), the calculation-waveform data pattern with ΔS=−1 has invalid bits respectively at the fourth second, 10-th second, 11-th second and 14-th second, and the number of invalid bits is 4. The calculation-waveform data pattern with ΔS=0 has invalid bits at the fourth second, 10-th second, 11-th second and 14-th second, and the 20-th second and the number of invalid bits is 5. The remaining calculation-waveform data pattern with ΔS=1 has invalid bits at the 21-th second in addition to those at the fourth second, 10-th second, 11-th second and 14-th second, and 20-th second, and the number of invalid bits is 6.

In the example shown in FIG. 11D, out of three calculation-waveform data patterns (Reference numeral: 1130), the calculation-waveform data pattern with ΔS=−1 has 5 invalid bits and the calculation-waveform data patterns with ΔS=0 and ΔS=1 have 6 invalid bits. In the example shown in FIG. 11E, three calculation-waveform data patterns (Reference numeral: 1140) each have 6 invalid bits. As described above, the number of invalid bits contained in the calculation-waveform data patterns with different ΔS can be changed depending on the number of bits and difference in the leading times of "second".

The error counting unit 32 compares the sample values of the valid bits of the calculation-waveform data patterns with the sample values of the corresponding bits of the input waveform data pattern to calculate the number of errors corresponding to non-coincidence between both sample values. In this case, the numbers of valid bits must coincide with each other in the plural calculation-waveform data patterns (three calculation-waveform data patterns in the examples shown in FIG. 11A to FIG. 11E). For instance, in the case of N=19 shown in FIG. 11A and in the case of N=23 shown in FIG. 11E, the numbers of invalid bits are coincident in the plural calculation-waveform data patterns. Therefore, in the example shown in FIG. 11A, the number N' of valid bits will be obtained by subtracting the number 4 of invalid bits from the original number 19 of bits (Refer to FIG. 12A). And in the example shown in FIG. 11E, the number (17) of valid bits will be obtained by subtracting the number 6 of invalid bits from the original number 23 of bits (Refer to FIG. 12E).

Meanwhile, in the case where the numbers of invalid bits are not coincident in the plural calculation-waveform data patterns, the smallest number of valid bits will be the adjusted number N' of the valid bits. In other words, in the example shown in FIG. 11B, the adjusted number (N'=16) of valid bits will be obtained by subtracting the maximum number 4 of invalid bits from the original number 20 of bits (Refer to FIG. 12B). In the example shown in FIG. 11C, the adjusted number (N'=15) of valid bits will be obtained by subtracting the maximum number 6 of invalid bits from the original number 21 of bits (Refer to FIG. 12C). In the example shown in FIG. 11D, the adjusted number (N'=16) of valid bits will be obtained by subtracting the maximum number 6 of invalid bits from the original number 22 of bits (Refer to FIG. 12D).

The pattern-length adjusting unit 33 of the error detecting unit 25 compares the numbers of valid bits in the plural calculation-waveform data patterns to find the smallest number (adjusted number N') of valid bits among them. Further, the pattern-length adjusting unit 33 obtains information representing positions of the valid bits based on the adjusted number N' of valid bits in each of the calculation-waveform data patterns, and supplies the information to the error counting unit 32 at step 604.

FIG. 13A to FIG. 13E are views illustrating the valid bits, which have been adjusted in the calculation-waveform data patterns shown in FIG. 11A to FIG. 11E. The plural calculation-waveform data patterns 1300 to 1340 shown in FIG. 13A to FIG. 13E are the same as those 1100 to 1140 shown in FIG. 11A to FIG. 11E. In the examples shown in FIG. 13A to FIG. 13E, the number N' of valid bits after subjected to the adjustment is the same as the original number of valid bits. In the case shown in FIG. 13B, the number N' of valid bits after subjected to the adjustment is 15. Therefore, in the calculation-waveform data pattern of ΔS=−1 (Reference numeral: 1311), the tail bit (bit at the 18-th second, Reference numeral: 1313) will be a bit to be removed (bit-to-be-removed) from the valid bits, which have been subjected to the adjustment. Similarly, in the calculation-waveform data pattern of ΔS=0 (Reference numeral: 1312), the tail bit (bit at the 19-th second, Reference numeral: 1314) will be a bit to be removed in the bit-length adjustment.

In the example shown in FIG. 13C, the number N' of valid bits after subjected to the adjustment is 15. Therefore, in the calculation-waveform data pattern of ΔS=1 (Reference numeral: 1321), the last two bits (bits at the 18-th second and the 19-th second, Reference numeral: 1323) are bits to be removed in the bit-length adjustment. Similarly, in the calculation-waveform data pattern of ΔS=0 (Reference numeral: 1322), the second bit from the last (bit at the 19-th second, Reference numeral: 1324) will be a bit to be removed in the bit-length adjustment. In the example shown in FIG. 13D, in the calculation-waveform data pattern of ΔS=−1 (Reference numeral: 1331), the second bit from the last (bits at the 19-th second, Reference numeral: 1332) will be a bit to be removed in the bit-length adjustment.

After having specified the invalid bits and executed the bit-length adjustment, the error counting unit 32 compares the sample values of the valid bits of the calculation-waveform data patterns subjected to the bit-length adjustment (bits with invalid bits and bits-to-be-removed excluded) to the sample values of the corresponding bits in the input waveform data pattern to calculate the number of errors corresponding to non-coincidence between both sample values or to detect discrepancies between both the sample values at step 605.

Figure 14A:
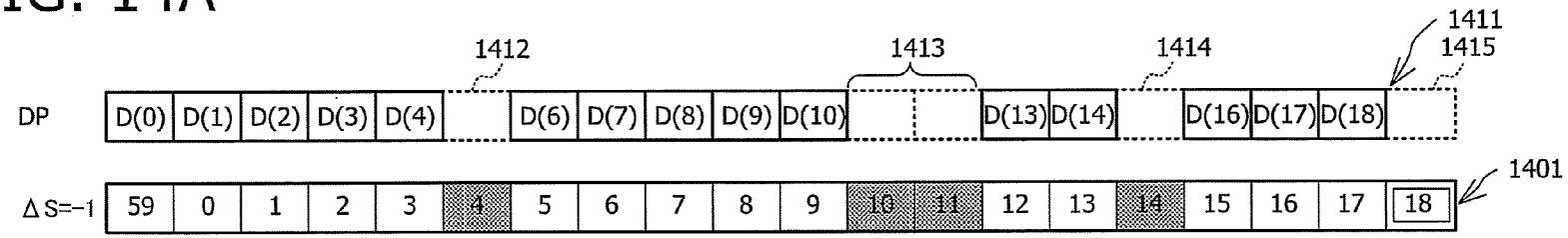
FIG. 14A, FIG. 14B and FIG. 14C are views for explaining the comparison of the sample values of the valid bits of calculation-waveform data patterns subjected to a bit-length adjustment with the corresponding sample values of the input waveform data pattern.
Figure 14B:
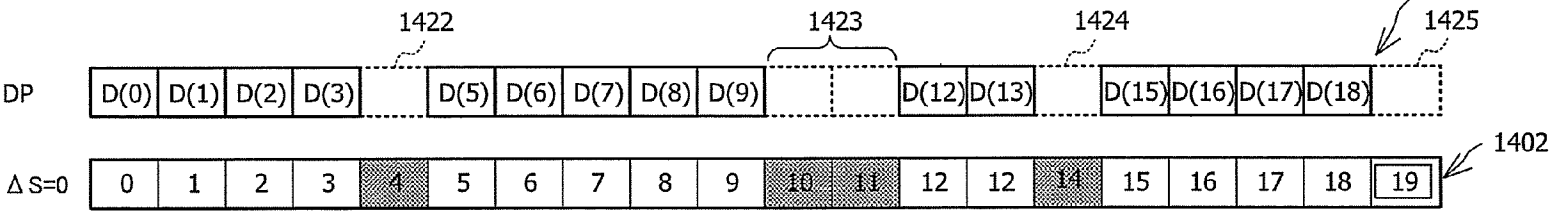
Figure 14C:
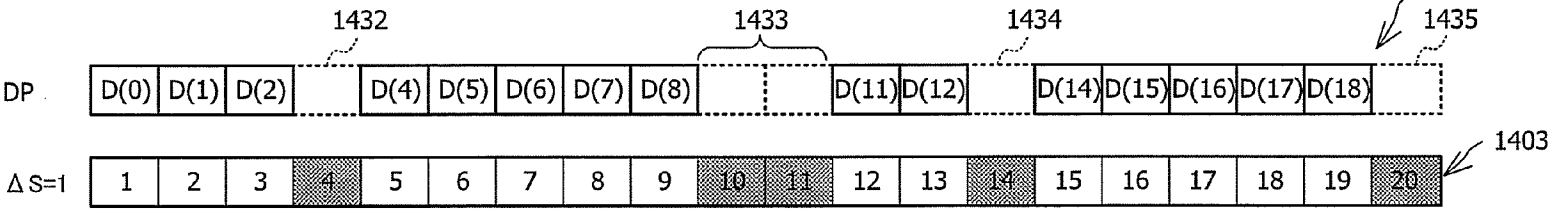
Figure 15A:
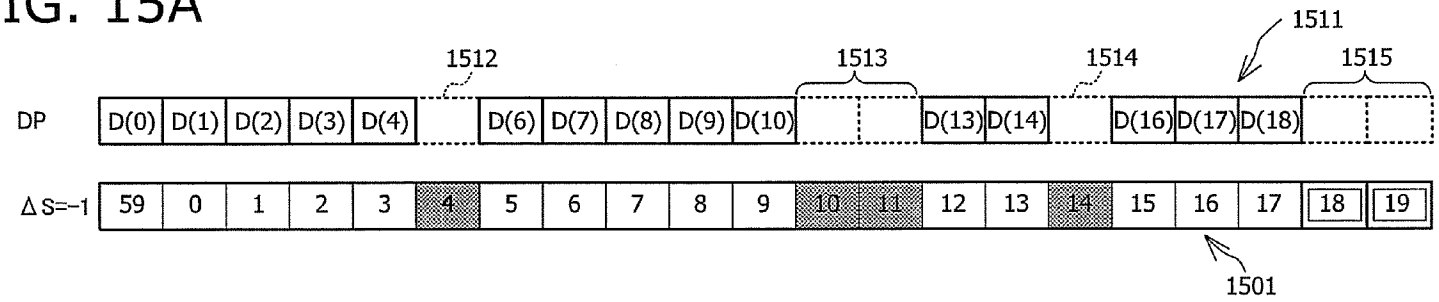
FIG. 15A, FIG. 15B and FIG. 15C are views for explaining the comparison of the sample values of the valid bits of calculation-waveform data patterns subjected to the bit-length adjustment with the corresponding sample values of the input waveform data pattern.

FIG. 14A to FIG. 14C and FIG. 15A to FIG. 15C are views for explaining the comparison of the sample values of the valid bits in the calculation-waveform data patterns subjected to the bit-length adjustment to the corresponding sample values in the input waveform data pattern. FIG. 14A is a view for explaining the example of N=20, (which corresponds to FIG. 11B and FIG. 13B) and FIG. 15A is a view for explaining the example of N=21, (which corresponds to FIG. 11C and FIG. 13C).

In the example of N=20 shown in FIG. 14A, in the input waveform data pattern DP (Reference numeral: 1411) to be compared with the calculation-waveform data pattern of ΔS=−1 (Reference numeral: 1401), the bits of D(5) (Reference numeral: 1412), D(11), D(12) (Reference numeral: 1413) and D(15) (Reference numeral: 1414) are bits corresponding to invalid bits of the calculation-waveform data pattern 1401, and the bit D(19) (Reference numeral: 1415) is a bit corresponding to a bit-to-be-removed. Therefore, the sample values of the bits at the 59-th second to the third second of the calculation-waveform data pattern are compared with D(0) to D(4) of the input waveform data pattern DP, respectively. The sample values of the bits at the fifth second to the ninth second of the calculation-waveform data pattern are compared with D(6) to D(10) of the input waveform data pattern DP, respectively. The sample values of the bits at the 12-th second to the 13-th second of the calculation-waveform data pattern are compared with D(13) to D(14) of the input waveform data pattern DP, respectively. And further, the sample values of the bits at the 15-th second to the 17-th second of the calculation-waveform data pattern are compared to D(16) to D (18) of the input waveform data pattern DP, respectively.

As shown in FIG. 14B, in the input waveform data pattern DP (Reference numeral: 1421) to be compared with the calculation-waveform data pattern of ΔS=0 (Reference numeral: 1402), the bits of D(4) (Reference numeral: 1422), D(10), D(11) (Reference numeral: 1423) and D(14) (Reference numeral: 1424) are bits corresponding to invalid bits of the calculation-waveform data pattern 1402, and the bit of D(19) (Reference numeral: 1425) is a bit corresponding to a bit-to-be-removed. Therefore, the sample values of bits other than the invalid bits and the bits-to-be-removed are compared with the sample values of the calculation-waveform data patterns.

As shown inn FIG. 14C, in the input waveform data pattern DP (Reference numeral: 1431) to be compared with the calculation-waveform data pattern of ΔS=1 (Reference numeral: 1403), bits indicated by Reference numerals 1432, 1433, 1434 and 1435 are bits corresponding to invalid bits.

Figure 15B:
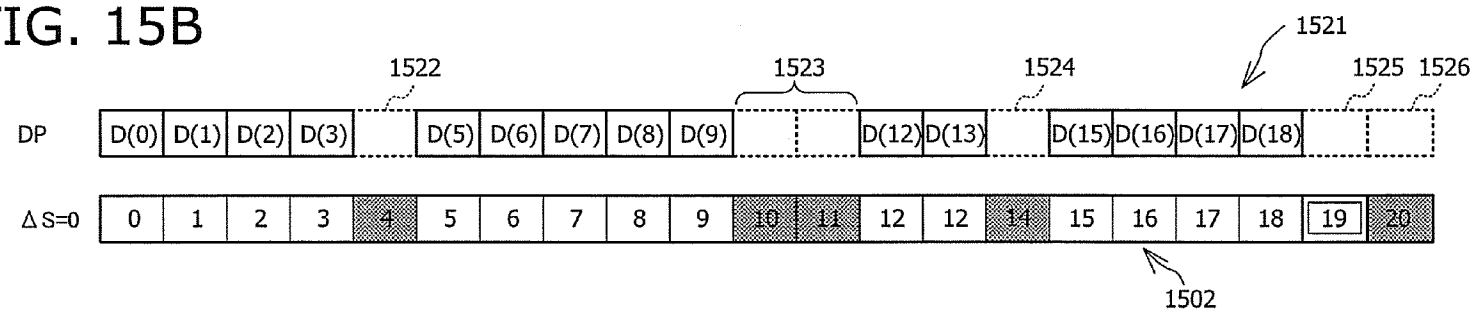
Figure 15C:
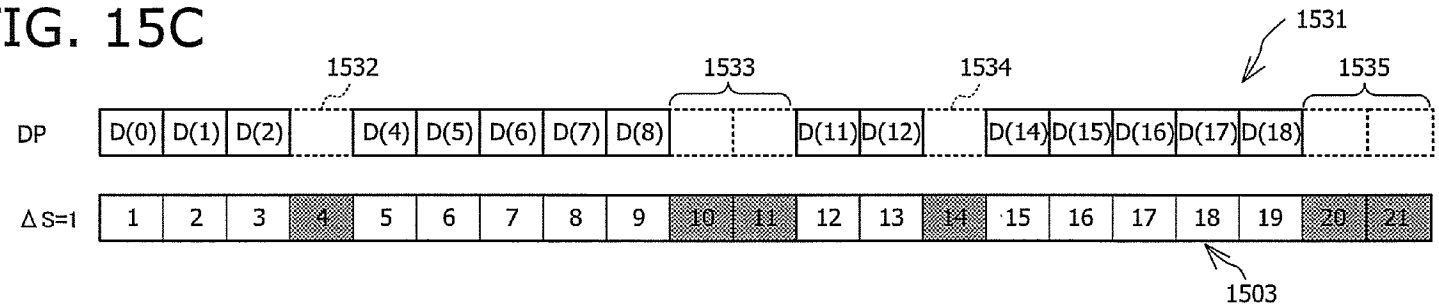

Further in FIG. 15A, in the input waveform data pattern DP (Reference numeral: 1511) to be compared with the calculation-waveform data pattern of ΔS=−1 (Reference numeral: 1501), bits indicated by Reference numerals 1512, 1513, and 1514 are bits corresponding to invalid bits, and a bit indicated by Reference numeral 1515 is a bit corresponding to a bit-to-be-removed. In FIG. 15B, in the input waveform data pattern DP (Reference numeral: 1521) to be compared with the calculation-waveform data pattern of ΔS=0 (Reference numeral: 1502), bits indicated by Reference numerals 1522, 1523, 1524 and 1526 are bits corresponding to invalid bits, and a bit indicated by Reference numeral 1525 is a bit corresponding to a bit-to-be-removed. In FIG. 15C, in the input waveform data pattern DP (Reference numeral: 1531) to be compared with the calculation-waveform data pattern of ΔS=1 (Reference numeral: 1503), bits indicated by Reference numerals 1532, 1533, 1534 and 1535 are bits corresponding to invalid bits.

As a result of comparison of the corresponding sample values, when both sample values coincide with each other, then the number of errors will be 0. Meanwhile, when both sample values do not coincide with each other, then the number of errors will be 1. The error counting unit 32 of the error detecting unit 25 counts the total number of errors based on the result of the comparison of the sample values with respect to each calculation-waveform data pattern.

The coincidence judging unit 26 calculates a bit error rate (BER) corresponding to each of the plural calculation-waveform data patterns based on the number of errors (total number of errors) calculated with respect to each of the plural calculation-waveform data patterns (step 606). For instance, the bit error rate (BER) can be calculated from calculation of (the total number of errors)/the number I of samples of the input waveform data pattern). The coincidence judging unit 26 finds the minimum bit error rate (minimum BER) among the calculated bit error rates at step 607. Then, the coincidence judging unit 26 obtains an allowable maximum bit error rate BERmax (I) determined in accordance with the number I of samples of the input waveform data pattern (step 608), and judges at step 609 whether or not the minimum bit error rate (minimum BER) is smaller than the allowable maximum bit error rate BERmax (I).

Hereinafter, the bit error rate will be described. The allowable maximum bit error rate BERmax (I) increases as the number of pieces of received data (the number of samples of input waveform data pattern) increases, or as data length increases. In other words, even if the error rate increases as the data length increases, reliability of data coincidence is kept high.

To avoid a miss judgment in the judgment of coincidence between the calculation-waveform data pattern and the input waveform data pattern, it is necessary to decrease to zero as possible the probability (error rate) for plural pieces of data to accord with each other by chance.

Assuming that the radio-controlled timepiece 10 receives the standard-time radio wave 24 times a day, and the radio-controlled timepiece 10 makes error once in 100 year, then the probability of error-coincidence will be set to about $1/10^6=1/(24\times365\times100)$. Hereinafter, it is assumed that the target value of the probability of error-coincidence is set to $1/10^8$.

The probability that the input waveform data pattern (sample value: 0 or 1) of N bits (N samples) coincides with the calculation-waveform data pattern by chance will be given as follows, where 0 and 1 will occur evenly. P0=P1=0.5, where P0 is the probability of occurrence of 0 and P1 is the probability of occurrence of 1. Assuming that the probability of error-coincidence is $P0^N<1/10^8$, N≥27. This means that when data of 27 bits is received and all the 27 bits coincide with the calculation-waveform data pattern, and reliability will be established.

In practice, there is a case where the probability of occurrence of 0 is not equal to the probability of occurrence of 1, that is, the probability of occurrence of 1 or 0 becomes one-sided such as P0>P1. In this case, if substantially the same calculation as above is performed, the probability of occurrences of 1 and 0 will be P0>P1. In general, in case of the numerical number, whose probability of occurrence is the highest, all the N bits are 0, and the probability of error-coincidence will be maximum, and the probability of occurrence of the numerical number will be $P0^N$.

Assuming that the probability of occurrence of the codes, P0=0.55, and P1=0.45, and when $P0^N<1/10^N$ is solved, N≥31 will be obtained. In other words, this means that if more 4 bits are not received, the reliability, which has been established in the case of P0=P1 (N=27), will not be obtained.

The case where all the N bits coincide with each other has been described in the above description, but it is rare because of noise effects in the poor magnetic field that all the N bits coincide with each other. Even though some bits, which do not coincide with each other are involved, if at least one solution of the probability of occurrence of not higher than $1/10^8$ is found, it can be determined that all the N bits coincide with each other.

In the case where the input waveform data pattern of N bits (N samples) includes "e" pieces of samples (the number of error bits), which do not coincide with the calculation-waveform data pattern, there is one sequence of codes, in which the input waveform data pattern and the calculation-waveform data pattern coincide with each other completely, and COMBIN (N, e) of sequences of codes, in which the input waveform data pattern includes "e" pieces of error bits, among the sequences of codes consisting of data 0 and 1. COMBIN (N. e) is the number of combinations of selecting "e" bits from among N bits.

If N is much larger than "e", that is, e<<N, the probability of occurrence of each of error bits can be considered as being substantially equivalent to the probability of complete coincidence between the input waveform data pattern and the calculation-waveform data pattern. Under the condition of P0>P1, the largest probability of occurrence among the completely non-coincidence between them will be $PO^N\cdot COMBIN(N, e)$. If the probability is not larger than $1/10^8$, the input waveform data pattern and the calculation-waveform data pattern can be considered to be coincident to each other, which can be proved by the following formula.

$$PO^N\cdot COMBIN(N, e)<1/10^8$$

When the above formula is solved with respect to N, where e=1, N≥40 will be obtained.

Similarly, operation is executed with respect to e=10, 21, 31 and 42, and the result will be obtained as follows:

e=10 N≥80 BER=0.125 e=21 N≥120 BER=0.175 e=31 N≥160 BER=0.194 e=42 N≥200 BER=0.21

From the above result of operation, it will be understood that the number "e" of allowable error bits required for securing the reliability varies in accordance with the number N of received bits.

In general, as N increases, "e" increases. Therefore, even if it is hard to correct the time because of poor BER, this feature will allow to correct the time, if the standard-time radio wave can be received in the period of a longer time to increase the number N of bits (or increase the number of sample values).

The radio-controlled timepiece 10 according to the first embodiment is provided with a maximum allowable BER table as shown in FIG. 16. In the maximum allowable BER table, each range of the number of samples of the input waveform data pattern is given a corresponding BERmax (I). From the maximum allowable BER table, the coincidence judging unit 26 obtains BERmax (I) corresponding to the number of samples of the input waveform data pattern (step 608).

The coincidence judging unit 26 compares the minimum BER obtained at step 607 with the maximum BERmax (I) obtained at step 608 to determine if the minimum BER<BERmax (I) is true (step 609). When it is determined at step 609 that the minimum BER<BERmax (I) (YES at step 609), the coincidence judging unit 26 supplies CPU 11 with information representing success of correction as correction-information and information of the calculation-waveform data pattern showing such minimum BER (step 610). The latter information represents a difference from the base time BT.

The difference time ΔT from the base time BT is given by the following formula.

ΔT=BT+s−(BT+Δt)=s−Δt, where "s" denotes a difference time from the base time BT in the leading code data of the calculation-waveform data pattern.

When it is determined at step 609 that the minimum BER<BERmax (I) is not true (NO at step 609), the coincidence judging unit 26 supplies CPU 11 with information representing failure in time correction as the correction-information (step 611). Upon receipt of the information representing success of correction as the correction-information (YES at step 506), CPU 11 stores the base time BT as the final correcting time Tlast in RAM 15 (step 507). And CPU 11 corrects the base time BT based on the difference time ΔT from the base time BT (step 508). At step 508, CPU 11 corrects the time counted by the internal time-counting circuit 17 and displays the corrected present time on the displaying unit 13.

When it is determined NO at step 502 or when it is determined NO at step 504, CPU 11 detects the leading positions of "minute" using a conventional well known technique (step 509), and specifies codes of "second" based on the detected leading positions of "minute", thereby decoding codes of minutes, times, and a day of the week to obtain the present time (step 510).

In the first embodiment of the invention, the waveform clipping unit 24 samples the standard-time radio wave from the leading position of "second" at the predetermined sampling rate, and generates the input waveform data pattern, which contains sample values at each sampling points, each having a first value representing a low level or a second value representing a high level, and also having a unit time length of a longer than 1. The calculation-waveform data pattern generating unit 23 generates plural calculation-waveform data patterns. The plural calculation-waveform data patterns each represent a sequence of codes in accordance with the base time BT counted by the internal time-counting circuit 17, and have the respective leading positions at the base time BT or at the times before or after the base time BT by several seconds (±ΔS seconds). Each of the calculation-waveform data patterns contains sample values at each sampling points, and each sample value has the first value or the second value and also has the same time length as the input waveform data pattern. The error detecting unit 25 compares the sample values of the input waveform data pattern to the corresponding sample values of the calculation-waveform data patterns to judge whether they coincide with each other, and counts the number of errors representing non-coincidences between them. The numbers of errors are counted with respect to the plural calculation-waveform data patterns, respectively. The coincidence judging unit 26 calculates the difference of the base time BT based on the leading position of the calculation-waveform data pattern showing the smallest number of errors. Therefore, the plural calculation-waveform data patterns are used to judge the codes in the first embodiment of the invention.

In particular, in the first embodiment of the invention, the invalid bit detecting unit 31 specifies the invalid bits in the calculation-waveform data patterns, and the sample values of the valid bits of the calculation-waveform data patterns with invalid bits removed and the corresponding sample values of the input waveform data pattern are compared. Therefore, since the sample values can be compared using only the valid bits, excluding the bits whose values are not uniquely determined based on the time, date, month, and year, the codes will be judged precisely.

In the first embodiment of the invention, the pattern-length adjusting unit 33 compares the numbers of valid bits included in the calculation-waveform data patterns with invalid bits removed and adjusts the lengths of the calculation-waveform data patterns so as to include the same number of valid bits. In other words, in addition to the invalid bits, the bits-to-be-removed are specified in those to be compared and removed from the calculation-waveform data patterns in the bit-length adjustment, and then the sample values of the valid bits of the calculation-waveform data patterns, which have been subjected the bit-length adjustment and the corresponding sample values of the input waveform data pattern are compared, whereby the number of errors is calculated using only the sample values of valid bits contained in the plural calculation-waveform data patterns, which have been subjected to the bit-length adjustment. Therefore, in the first embodiment of the invention, the number of samples (number of bits) of the plural calculation-waveform data patterns, which is to be used to calculate the number of errors, is made equivalent, whereby the reliability in calculation of the number of errors can be secured.

Now, the second embodiment of the invention will be described. In the first embodiment of the invention, the bits-to-be-removed from those to be compared are specified in the calculation-waveform data patterns by the bit-length adjustment. Then, the sample values of the valid bits of the calculation-waveform data patterns with the invalid bits and the specified bits-to-be-removed removed in the bit-length adjustment are compared with the corresponding sample values of the input waveform data pattern. On the other hand, in the second embodiment of the invention, plural calculation-waveform data patterns are generated, which contain the least number of invalid bits as possible and contain the same numbers of bits, respectively.

FIG. 17A, FIG. 17B, and FIG. 17C are views illustrating functions of bits of the standard-time radio wave signal in conformity with DCF77. Like the standard-time radio wave signal JJY shown in FIG. 9A, FIG. 9B, and FIG. 9C, in the tables shown in FIG. 17A, FIG. 17B and FIG. 17C, the top (Reference numeral: 1710) indicates a time lapsed from the beginning of "second", the middle (Reference numeral: 1711) indicates contents of the codes, and the bottom (Reference numeral: 1712) indicates meanings of the values. In FIG. 17A, FIG. 17B and FIG. 17C, "Enlargement" (Reference numeral: 1701) in the bottom indicates enlargement bits. The bits concerning the practice of Summer Time and bits representing the leap seconds are not used in the time signal of the standard-time radio wave at present, but bits to be used only in a specified period of time are set in the period (Reference numeral: 1702) from the 15-th second to the 19-th second. Therefore, in the time signal of the standard-time radio wave in conformity with DCF77, bits corresponding to the first second to the 19-th second are invalid bits.

As will be understood from FIG. 17A, FIG. 17B and FIG. 17C, invalid bits continue from the first second to the 19-th second in the standard-time radio wave signal DCF77. FIG. 18A and FIG. 18B are views illustrating examples of the calculation-waveform data patterns based on the standard-time radio wave signal in conformity with DCF77. The calculation-waveform data patterns (Reference numerals: 1800, 1810) contain 30 bits (The number of bits is 30). In the example shown in FIG. 18A, the process starting time "Now" is 0 second, and the calculation-waveform data pattern of ΔS=0 starts with the code corresponding to 0 second. In the example shown in FIG. 18B, the process starting time "Now" is 21 second, and the calculation-waveform data pattern of ΔS=0 starts with the code corresponding to 21 second. In FIG. 18A and FIG. 18B, invalid bits (Reference numerals: 1803, 1804) in the calculation-waveform data patterns are shown in grey.

In the example shown in FIG. 18A, three calculation-waveform data patterns (ΔS=−1, 0, 1) (Reference numeral: 1801) are considered. Each of these three calculation-waveform data patterns contain 19 invalid bits and the number of valid bits is 11. Meanwhile, in the example shown in FIG. 18B, three calculation-waveform data patterns (ΔS=−1, 0, 1) (Reference numeral: 1802) are considered. These three calculation-waveform data patterns contain no invalid bit and all the 30 bits can be used as the valid bits.

In the second embodiment of the invention, invalid bits appear continuously. A method is employed, appropriate for processing the standard-time radio wave signal such as DCF77, and the starting times (starting positions) and bit lengths of plural calculation-waveform data patterns are adjusted such that the number of invalid bits contained in each data pattern will be less than a predetermined number. In particular, in the second embodiment of the invention, calculation-waveform data patterns including only valid bits are obtained.

Figure 19:
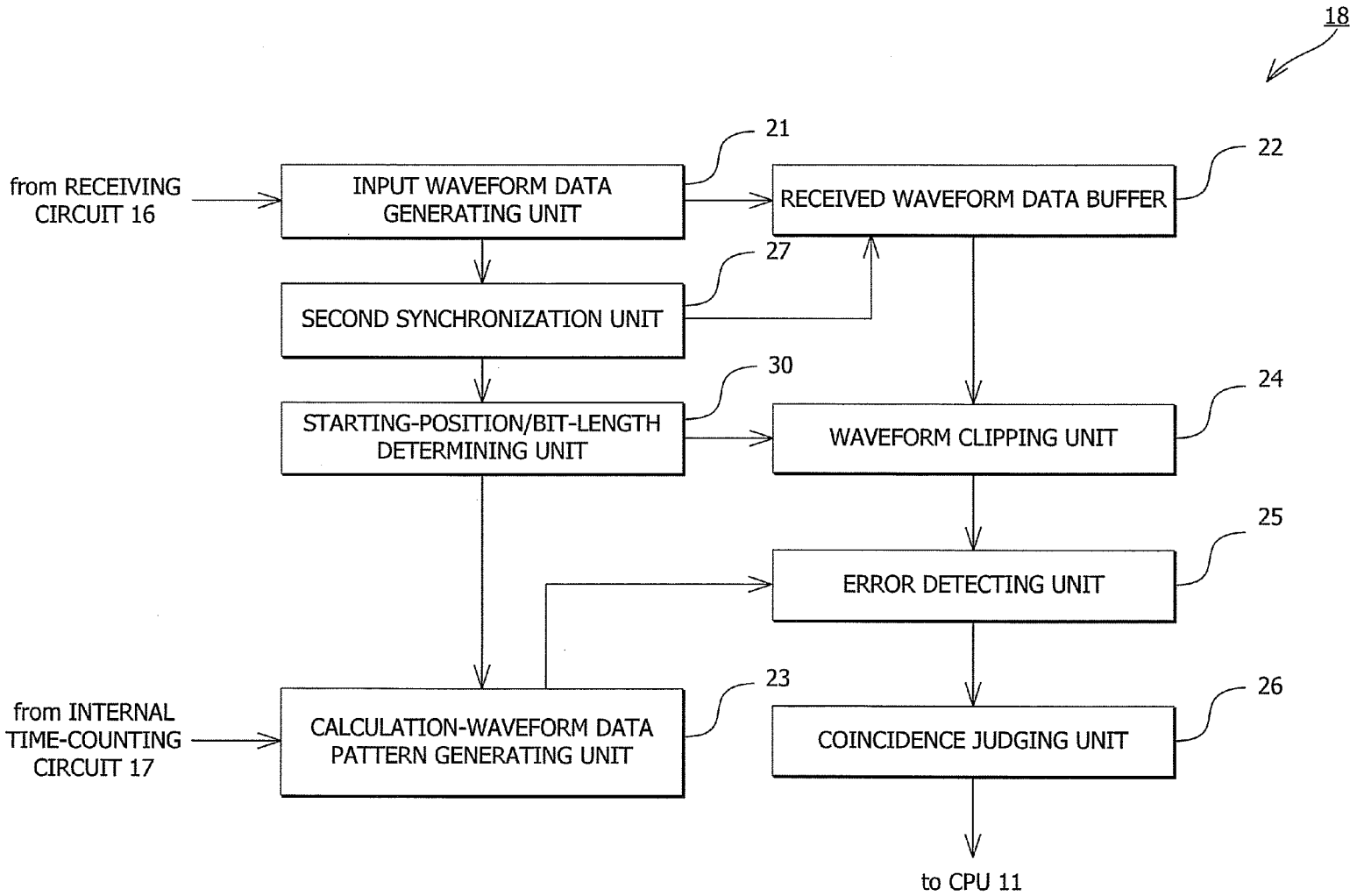
FIG. 19 is a block diagram of a configuration of the signal comparing circuit in the second embodiment of the invention.

FIG. 19 is a block diagram of a configuration of the signal comparing circuit 18 in the second embodiment of the invention. In FIG. 19, like elements as those in the signal comparing circuit 18 of the first embodiment shown in FIG. 3 are designated by like reference numerals, and their description will be omitted. As shown in FIG. 19, the signal comparing circuit 18 in the second embodiment has a starting-position/bit-length determining unit (calculation-waveform data pattern determining unit and input waveform data pattern determining unit) 30, which determines the bit length and the respective starting positions of plural calculation-waveform data patterns. The starting-position/bit-length determining unit 30 determines the starting positions (starting times) of the calculation-waveform data patterns and the bit length of the calculation-waveform data pattern such that the calculation-waveform data patterns will contain no invalid bit. The starting positions (starting times) of the calculation-waveform data pattern are supplied to the waveform clipping unit 24. In accordance with the starting positions and bit length of the calculation-waveform data patterns, the waveform clipping unit 24 obtains an input waveform data having a bit length starting from a predetermined position.

FIG. 20 to FIG. 22 are views for explaining the starting times and bit lengths of the calculation-waveform data in the second embodiment of the invention. As in the first embodiment of the invention, in the second embodiment, plural calculation-waveform data patterns are generated upon calculation of the assumable maximum error. FIG. 20 is a table showing a case, in which three calculation-waveform data patterns of ΔS=−1, 0, 1 (Reference numeral: 2000) are generated.

FIG. 21 is a table showing a case, in which five calculation-waveform data patterns of ΔS=−2, −1, 0, 1, 2 (Reference numeral: 2100) are generated, and FIG. 22 is a table showing a case, in which 11 calculation-waveform data patterns of ΔS=−5, −4, −2, −1, 0, 1, 2, 3, 4, 5 (Reference numeral: 2200) are generated. In FIG. 20 to FIG. 22, bits (Reference numerals: 2001, 2002, 2101, 2102, 2201 and 2202) shown in grey represent invalid bits.

In the second embodiment of the invention, to generate the calculation-waveform data patterns each consisting of valid bits only, all that is required is that the leading bit of the calculation-waveform data pattern of the minimum ΔS will correspond to the bit following the tail bit of a sequence of invalid bits, and the tail bit of the calculation-waveform data pattern of the maximum ΔS will correspond to the bit just before the leading bit of the sequence of invalid bits. The calculation-waveform data pattern of the minimum ΔS is the calculation-waveform data pattern which takes the most advanced position in time, and the calculation-waveform data pattern of the maximum ΔS is the calculation-waveform data pattern which takes the last position in time.

In the example shown in FIG. 20, among the three calculation-waveform data patterns (Reference numeral: 2000), the calculation-waveform data pattern of ΔS=−1 has the leading bit of a sample value corresponding to the code of the 20-th second. As will be understood from FIG. 20, the bits (bit corresponding to the 19-th bit) just before the above leading bit corresponds to the tail bit of the sequence of invalid bits. And the tail bit of the calculation-waveform data pattern of ΔS=1 has a sample value corresponding to the code of the 0-th second. The bit (bit of the first second) following the above tail bit corresponds to the leading bit of a sequence of invalid bits. Therefore, in this example, the calculation-waveform data patterns will have a bit length of 39 bits.

In the example shown in FIG. 21, among the five calculation-waveform data patterns (Reference numeral: 2100), the calculation-waveform data pattern of ΔS=−2 has the leading bit of a sample value corresponding to the code of the 20-th second. As will be understood from FIG. 21, the bits (bit corresponding to the 19-th bit) just before the above leading bit corresponds to the tail bit of the sequence of invalid bits. And the tail bit of the calculation-waveform data pattern of ΔS=2 has a sample value corresponding to the code of the 0-th second. The bit (bit of the first second) following the above tail bit corresponds to the leading bit of a sequence of invalid bits. Therefore, in this example, the calculation-waveform data patterns will have a bit length of 37 bits.

In the example shown in FIG. 22, among 11 calculation-waveform data patterns (Reference numeral: 2200), the calculation-waveform data pattern of ΔS=−5 has the leading bit of a sample value corresponding to the code of the 20-th second. As will be understood from FIG. 22, the bits (bit corresponding to the 19-th bit) just before the above leading bit corresponds to the tail bit of the sequence of invalid bits. And the tail bit of the calculation-waveform data pattern of ΔS=5 has a sample value corresponding to the code of the 0-th second. The bit (bit of the first second) following the above tail bit corresponds to the leading bit of a sequence of invalid bits. Therefore, in this example, the calculation-waveform data patterns will have a bit length of 31 bits.

In the second embodiment of the invention, the starting-position/bit-length determining unit 30 can obtain the starting time (starting position) of the leading bit of the calculation-waveform data pattern of ΔS=0 and the number of bits of the calculation-waveform data pattern from the number of calculation-waveform data patterns generated based on the assumable maximum error. For instance, an arrangement may be made, in which a table that associates the number of calculation-waveform data patterns with the starting positions and the number of bits is previously prepared and stored in RAM 15 and the starting-position/bit-length determining unit 30 is allowed to refer to the table to obtain the starting times and the number of bits.

Figure 23:
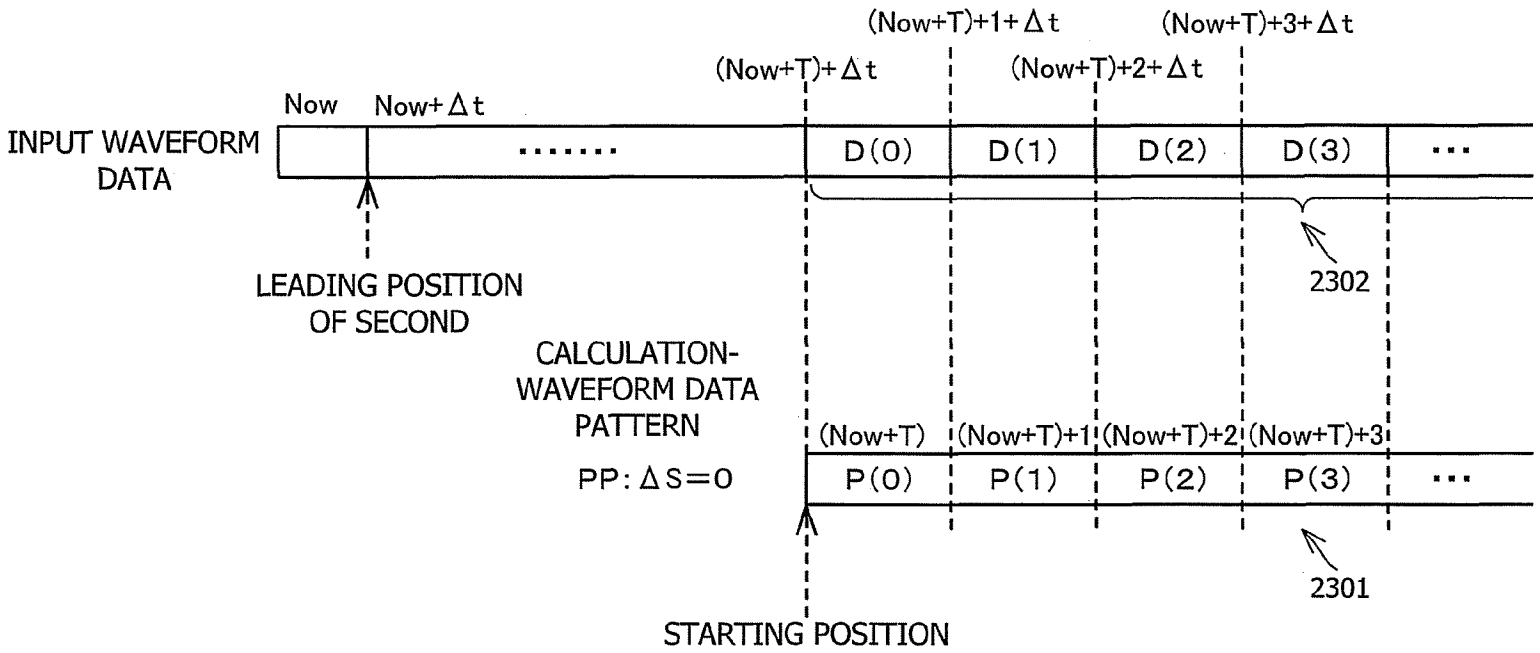
FIG. 23 is a view for explaining a process starting time "Now" and starting positions of the calculation-waveform data pattern and the input waveform data pattern in the second embodiment of the invention.

Further, in the second embodiment of the invention, the calculation-waveform data pattern of ΔS=0 does not start from the process starting time "Now", which is used in the second-synchronization, but starts from the starting time (starting position) determined by the starting-position/bit-length determining unit 30. Accordingly, it is required to adjust the starting position of the input waveform data pattern based on a time difference between the starting time and the process starting time. FIG. 23 is a view for explaining the process starting time "Now" and the starting positions of the calculation-waveform data pattern and the input waveform data pattern in the second embodiment of the invention.

As shown in FIG. 23, the leading position of "second" obtained in the second synchronization performed by the second synchronization unit 27 lags by Δt behind the process starting time "Now" based on the base time BT. Assuming that a time difference between the process starting time "Now" and the starting position (starting time) obtained by the starting-position/bit-length determining unit 30 is given by "T" as shown in FIG. 23, the leading position of the input waveform data pattern lags by "T" behind the leading position of "second", "Now+ΔT" and will be (Now+T)+Δt. The starting-position/bit-length determining unit 30 supplies the waveform clipping unit 24 with information representing the leading position of the input waveform data pattern together with the bit length.

Then, the waveform clipping unit 24 clips the input waveform data on the basis of the time (Now+T)+Δt and positions separate in units of second from said time (Now+T)+Δt, thereby generating the input waveform data pattern (Reference numeral: 2302) having a predetermined bit length. {0112} The error detecting unit 25 compares the sample values (P(0), P(1), P(2), . . . ) of bits of the calculation-waveform data pattern of ΔS=0 (Reference numeral: 2301 in FIG. 23) with the corresponding sample values (D(0), D(1), D(2), . . . ) of bits of the input waveform data pattern (Reference numeral: 2302 in FIG. 23).

In the second embodiment of the invention, the starting-position/bit-length determining unit 30 determines the respective starting positions of the calculation-waveform data patterns such that not more than a predetermined number of invalid bits are contained in the calculation-waveform data patterns. Meanwhile, the waveform clipping unit 24 generates the input waveform data pattern having the starting position, which coincides with the starting positions of the calculation-waveform data patterns, whereby the input waveform data pattern can include more valid bits to be compared with those of the calculation-waveform data patterns and the bits can be used effectively.

Particularly, in the second embodiment of the invention, the starting-position/bit-length determining unit 30 determines the respective starting positions of the plural calculation-waveform data patterns and the number of bits contained in the calculation-waveform data patterns such that no invalid bit is contained therein, whereby the bits are used effectively. Further, since invalid bits are removed in the units of bits and no bit length adjustment is required, the process can be simplified.

More particularly, in the second embodiment of the invention, the starting-position/bit-length determining unit 30 determines the respective starting positions of the plural calculation-waveform data patterns and the number of bits to be contained in the calculation-waveform data pattern such that the leading bit of the calculation-waveform data pattern which takes the most advanced position in time corresponds to the bit following the tail bit of a sequence of invalid bits and the tail bit of the calculation-waveform data pattern which takes the last position in time corresponds to the bit just before the leading bit of a sequence of invalid bits. In this way, the maximum number of bits can be contained in the calculation-waveform data patterns and the code can be judged with a high degree of accuracy.

Although specific embodiments of the present invention have been described in the foregoing detailed description with reference to the accompanying drawings, it will be understood that the invention is not limited to the particular embodiments described herein, but numerous rearrangements, modifications, and substitutions may be made without departing from the scope of the invention. The following claims are intended to encompass all such modifications.

For instance, in the first embodiment of the invention, invalid bits are detected in each of the calculation-waveform data patterns and the sample values of valid bits of the respective calculation-waveform data patterns with invalid bits removed are compared to the corresponding sample values of the input waveform data pattern, whereby the number of errors is calculated. It is possible in the first embodiment of the invention to employ the arrangement of the second embodiment, which determines the respective starting positions of the plural calculation-waveform data patterns and the number of bits such that no invalid bit is included in the calculation-waveform data patterns.

In the standard-time radio wave in conformity with JJY, 5 invalid bits continue at the 34-th second to the 38-th second (Reference numeral: 906) and one invalid bit (Reference numeral: 907) follows the 39-th second marker, as shown in FIG. 9A, FIG. 9B and FIG. 9C. Further, 6 invalid bits continue at the 53-th second to the 58-th second. Therefore, an arrangement can be made, which assumes the bits at the 34-th second to the 40-th second and at the 53-th second to 58-th second as invalid bits, and makes the calculation-waveform data pattern generating unit 23 determine the respective starting positions of the plural calculation-waveform data patterns and the number of bits to be contained in the calculation-waveform data patterns so as to exclude the above invalid bits. Even in this arrangement, the calculation-waveform data patterns can contain other invalid bits (for example, the enlargement bits, Reference numeral: 902 in FIG. 9A). In this case, the arrangement performs a process for removing the invalid bits from those to be compared, as in the first embodiment of the invention, whereby the calculation-waveform data patterns can contain the larger number of bits to be compared and the bits are used more effectively.

In the second embodiment of the invention, the starting-position/bit-length determining unit 30 determines the respective starting positions of the plural calculation-waveform data patterns and the bit length of the calculation-waveform data patterns such that no invalid bit is contained in the calculation-waveform data patterns. But the invention is not limited to the second embodiments described herein, the starting-position/bit-length determining unit 30 can determine the starting positions of the plural calculation-waveform data patterns and the bit length of the calculation-waveform data patterns such that the number of invalid bits to be contained in the calculation-waveform data patterns will be less than a predetermined number.

In the first and the second embodiment of the invention, in the case where the obtained minimum BER is not less than the allowable maximum bit error BERmax (I), it is determined that the correction has failed (step 611). In this case, the process may be executed again at step 505. In the first embodiment, the input waveform data pattern is generated again at step 505, which will be longer than the input waveform data pattern generated previously at step 505, in other words, the input wave form data pattern containing the larger number of codes will be generated. Using the larger number N of bits, the probability of the time correction can be increased.

In the first and the second embodiment of the invention, the minimum BER and the allowable maximum bit error BERmax (I) are compared, but the invention is not limited to this, but other method can be employed without departing from the scope of the invention.

What is claimed is:

1. A time-information obtaining apparatus comprising:

a receiving unit for receiving a standard-time radio wave to obtain and output a time signal, which includes a time code comprising plural bits;

an input waveform data pattern generating unit for sampling the time signal output from the receiving unit to generate an input waveform data pattern;

an internal time counting unit with a built-in clock signal generator, for counting a base time based on a clock signal;

a calculation-waveform data pattern generating unit for generating plural calculation-waveform data patterns having the same time length as the input waveform data pattern based on the base time counted by the internal time counting unit;

an error detecting unit for comparing sample values of the input waveform data pattern with sample values of the plural calculation-waveform data patterns to detect discrepancies between the input waveform data pattern and the calculation-waveform data patterns, thereby obtaining a number of errors between the input waveform data pattern and each of the plural calculation-waveform data patterns, wherein the number of errors represents a number of discrepancies; and a present-time correcting unit for correcting the base time counted by the internal time counting unit based on the calculation-waveform data pattern having a smallest number of errors, wherein the error detecting unit comprises:

an invalid-bit detecting unit for detecting, among bits of the plural calculation-waveform data patterns, invalid bits having sample values not to be compared with the input waveform data pattern; and an error counting unit for comparing the sample values of valid bits of the plural calculation-waveform data patterns having the invalid bits removed with the sample values of the corresponding bits of the input waveform data pattern to detect the discrepancies.

2. The time-information obtaining apparatus according to claim 1, wherein the error detecting unit has a bit number adjusting unit for comparing the respective numbers of valid bits of the plural calculation-waveform data patterns having the invalid bits removed, thereby adjusting the plural calculation-waveform data patterns so as to contain the same number of valid bits, and the error counting unit calculates the number of errors using the sample values of valid bits of the calculation-waveform data patterns adjusted by the bit number adjusting unit.

3. The time-information obtaining apparatus according to claim 1, further comprising:

a calculation-waveform data pattern determining unit for determining respective starting positions of the plural calculation-waveform data patterns such that the number of invalid bits included in each calculation-waveform data pattern will be less than a predetermined number; and an input waveform data pattern determining unit for determining a starting position of the input waveform data pattern so as to conform to the starting positions determined by the calculation-waveform data pattern determining unit.

4. The time-information obtaining apparatus according to claim 2, further comprising:

a calculation-waveform data pattern determining unit for determining respective starting positions of the plural calculation-waveform data patterns such that the number of invalid bits included in each calculation-waveform data pattern will be less than a predetermined number; and an input waveform data pattern determining unit for determining a starting position of the input waveform data pattern so as to conform to the starting positions determined by the calculation-waveform data pattern determining unit.

5. The time-information obtaining apparatus according to claim 3, wherein the calculation-waveform data pattern determining unit determines the respective starting positions of the plural calculation-waveform data patterns having invalid bits removed and the number of bits.

6. The time-information obtaining apparatus according to claim 4, wherein the calculation-waveform data pattern determining unit determines the respective starting positions of the plural calculation-waveform data patterns having invalid bits removed and the number of bits.

7. The time-information obtaining apparatus according to claim 5, wherein the calculation-waveform data pattern determining unit determines the respective starting positions of the plural calculation-waveform data patterns having invalid bits removed and the number of bits, such that a leading bit of the calculation-waveform data pattern will correspond to a bit following a tail bit of a sequence of invalid bits and a tail bit of the calculation-waveform data pattern will correspond to a bit just before a leading bit of a sequence of bits.

8. The time-information obtaining apparatus according to claim 6, wherein the calculation-waveform data pattern determining unit determines the respective starting positions of the plural calculation-waveform data patterns having invalid bits removed and the number of bits, such that a leading bit of the calculation-waveform data pattern will correspond to a bit following a tail bit of a sequence of invalid bits and a tail bit of the calculation-waveform data pattern will correspond to a bit just before a leading bit of a sequence of bits.

9. A time-information obtaining apparatus comprising:

a receiving unit for receiving a standard-time radio wave to obtain and output a time signal, which includes a time code comprising plural bits;

an input waveform data pattern generating unit for sampling the time signal output from the receiving unit to generate an input waveform data pattern;

an internal time counting unit with a built-in clock signal generator, for counting a base time based on a clock signal;

a calculation-waveform data pattern generating unit for generating plural calculation-waveform data patterns having the same time length as the input waveform data pattern based on the base time counted by the internal time counting unit;

an error detecting unit for comparing sample values of the input waveform data pattern with sample values of the plural calculation-waveform data patterns to detect discrepancies between the input waveform data pattern and the calculation-waveform data patterns, thereby obtaining a number of errors between the input waveform data pattern and each of the plural calculation-waveform data patterns, wherein the number of errors represents a number of discrepancies;

a present-time correcting unit for correcting the base time counted by the internal time counting unit based on the calculation-waveform data pattern having a smallest number of errors;

a calculation-waveform data pattern determining unit for determining respective starting positions of the plural calculation-waveform data patterns such that a number of invalid bits not to be compared among bits of the plural calculation-waveform data patterns will be less than a predetermined number; and an input waveform data pattern determining unit for determining a starting position of the input waveform data pattern so as to conform to the starting positions determined by the calculation-waveform data pattern determining unit.

10. The time-information obtaining apparatus according to claim 9, wherein the calculation-waveform data pattern determining unit determines the respective starting positions of the plural calculation-waveform data patterns having invalid bits removed and the number of bits.

11. The time-information obtaining apparatus according to claim 10, wherein the calculation-waveform data pattern determining unit determines the respective starting positions of the plural calculation-waveform data patterns having invalid bits removed and the number of bits, such that a leading bit of the calculation-waveform data pattern will correspond to a bit following a tail bit of a sequence of invalid bits and a tail bit of the calculation-waveform data pattern will correspond to a bit just before a leading bit of a sequence of bits.

12. A radio-controlled timepiece comprising:

a time-information obtaining apparatus as defined in claim 1; and a displaying unit for displaying the base time.

13. A radio-controlled timepiece comprising:

a time-information obtaining apparatus as defined in claim 2; and a displaying unit for displaying the base time.

14. A radio-controlled timepiece comprising:

a time-information obtaining apparatus as defined in claim 3; and a displaying unit for displaying the base time.

15. A radio-controlled timepiece comprising:

a time-information obtaining apparatus as defined in claim 5; and a displaying unit for displaying the base time.

16. A radio-controlled timepiece comprising:

a time-information obtaining apparatus as defined in claim 7; and a displaying unit for displaying the base time.

17. A radio-controlled timepiece comprising:

a time-information obtaining apparatus as defined in claim 9; and a displaying unit for displaying the base time.

18. A radio-controlled timepiece comprising:

a time-information obtaining apparatus as defined in claim 10; and a displaying unit for displaying the base time.

19. A radio-controlled timepiece comprising:

a time-information obtaining apparatus as defined in claim 11; and a displaying unit for displaying the base time.

* * * * *